United States Patent [19]

Kawaguchi et al.

[11] Patent Number: 5,016,231

[45] Date of Patent: May 14, 1991

[54] APPARATUS FOR ELECTRONICALLY CORRECTING AN ELECTRONIC TIMEPIECE

[75] Inventors: Takashi Kawaguchi; Hiroshi Yabe; Akihiko Maruyama; Hiroyuki Kubo, all of Suwa, Japan

[73] Assignee: Seiko Epson Corporation, Tokyo, Japan

[21] Appl. No.: 340,620

[22] Filed: Apr. 19, 1989

[30] Foreign Application Priority Data

Apr. 19, 1988 [JP] Japan ..... 63-96225
Jul. 1, 1988 [JP] Japan ..... 63-165261

[51] Int. Cl.[5] ..... G04B 19/04; G04B 27/08

[52] U.S. Cl. ..... 368/80; 368/74; 368/187

[58] Field of Search ..... 368/21, 22, 72–74, 368/76, 80, 185, 187, 220, 223

[56] References Cited

U.S. PATENT DOCUMENTS

| | | | |
|---|---|---|---|
| 4,275,463 | 6/1981 | Ishida | 368/187 |
| 4,357,693 | 11/1982 | Plancon et al. | 368/187 |
| 4,382,686 | 5/1983 | Giger et al. | 368/187 |
| 4,445,785 | 5/1984 | Chambon et al. | 368/187 |
| 4,623,261 | 11/1986 | Muto | 368/113 |
| 4,652,140 | 3/1987 | Nakazawa | 368/74 |

*Primary Examiner*—Vit W. Miska
*Attorney, Agent, or Firm*—Blum Kaplan

[57] ABSTRACT

An electronically correcting electronic timepiece is provided having indicating hands for indicating the time of day or the passage of time. At least one step motor is provided for driving the indicator. A correction signal forming circuit produces drive pulses for driving the step motor to correct the indicator. A control circuit controls the correction signal forming circuit to accelerate and decelerate the indicator in a step manner during correction of the indicator.

5 Claims, 22 Drawing Sheets

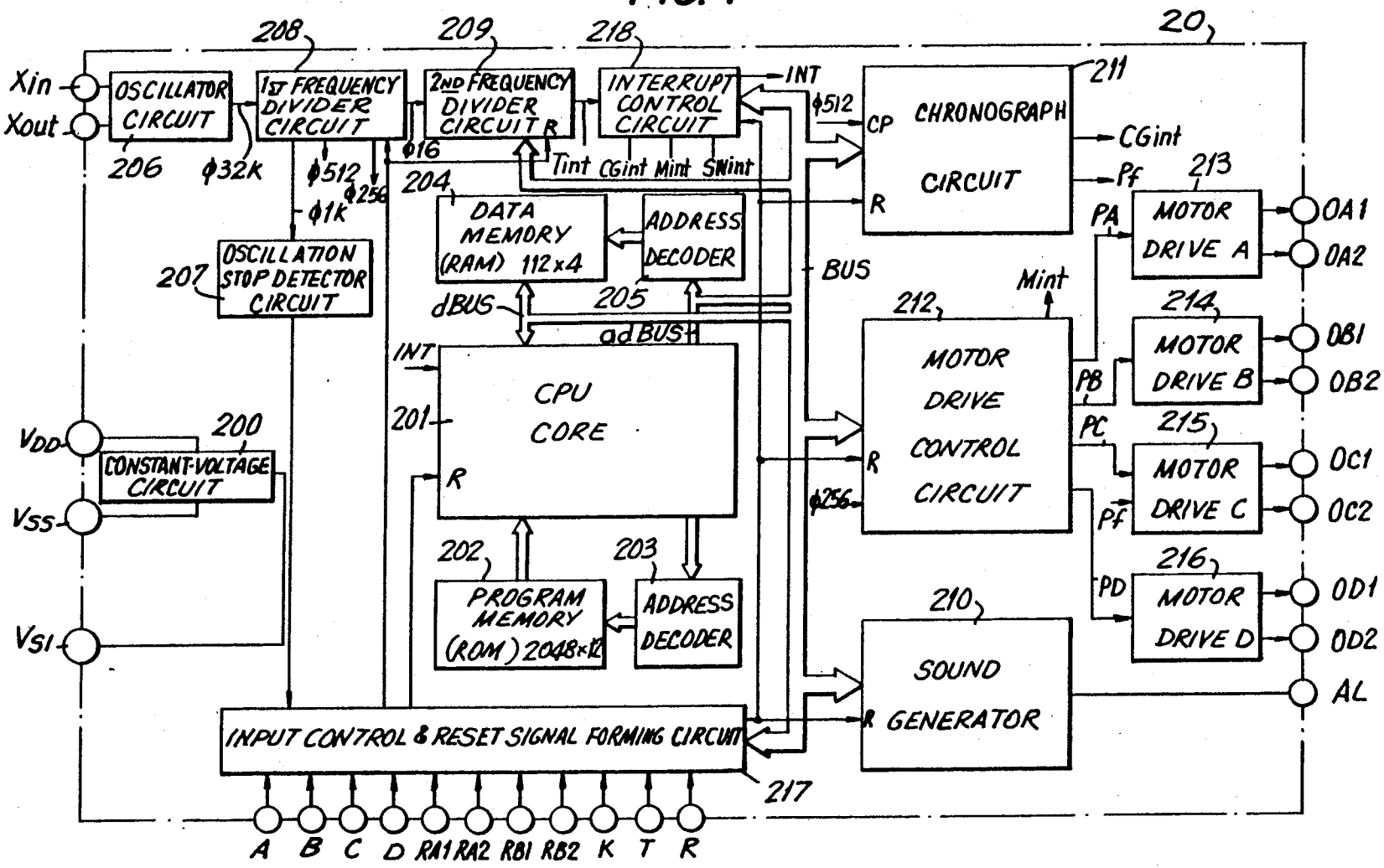
FIG. 1
20
OA1
OA2
OB1
OB2
OC1
OC2
OD1
OD2
AL
MOTOR DRIVE A
MOTOR DRIVE B
MOTOR DRIVE C
MOTOR DRIVE D
213
214
215
216
CGint
Pf
PA
PB
PC
PD
211
CHRONOGRAPH CIRCUIT
CP
R
Mint
MOTOR DRIVE CONTROL CIRCUIT
212
SOUND GENERATOR
210
BUS
φ512
INT
INTERRUPT CONTROL CIRCUIT
218
SWint
ADDRESS DECODER
205
ad BUS
CPU CORE
201
203
ADDRESS DECODER
PROGRAM MEMORY (ROM) 2048×12
202
DATA MEMORY (RAM) 112×4
204
dBUS
Tint
2ND FREQUENCY DIVIDER CIRCUIT
209
φ16
1ST FREQUENCY DIVIDER CIRCUIT
208
φ512
φ256
φ1k
φ32k
OSCILLATION STOP DETECTOR CIRCUIT
207
OSCILLATOR CIRCUIT
206
CONSTANT-VOLTAGE CIRCUIT
200
INPUT CONTROL & RESET SIGNAL FORMING CIRCUIT
217
A B C D RA1 RA2 RB1 RB2 K T R
Xin
Xout
VDD
VSS
VSI FIG. 18a
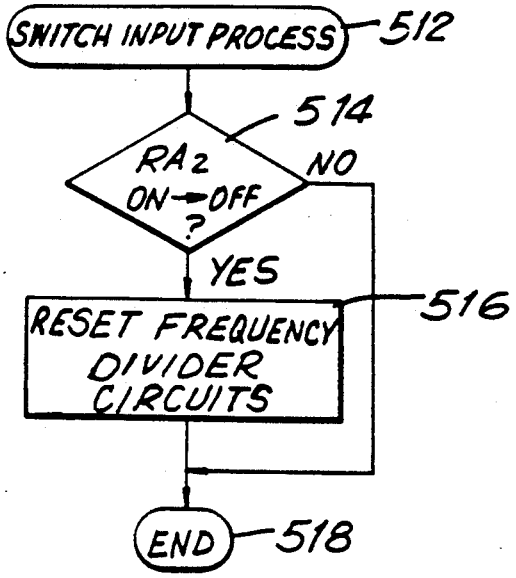
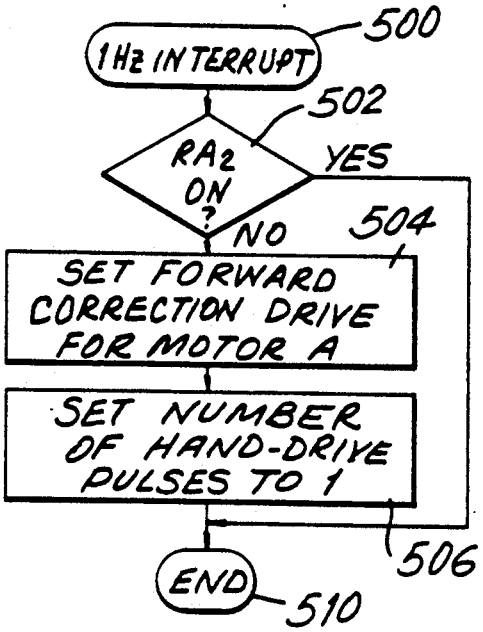
FIG. 18b

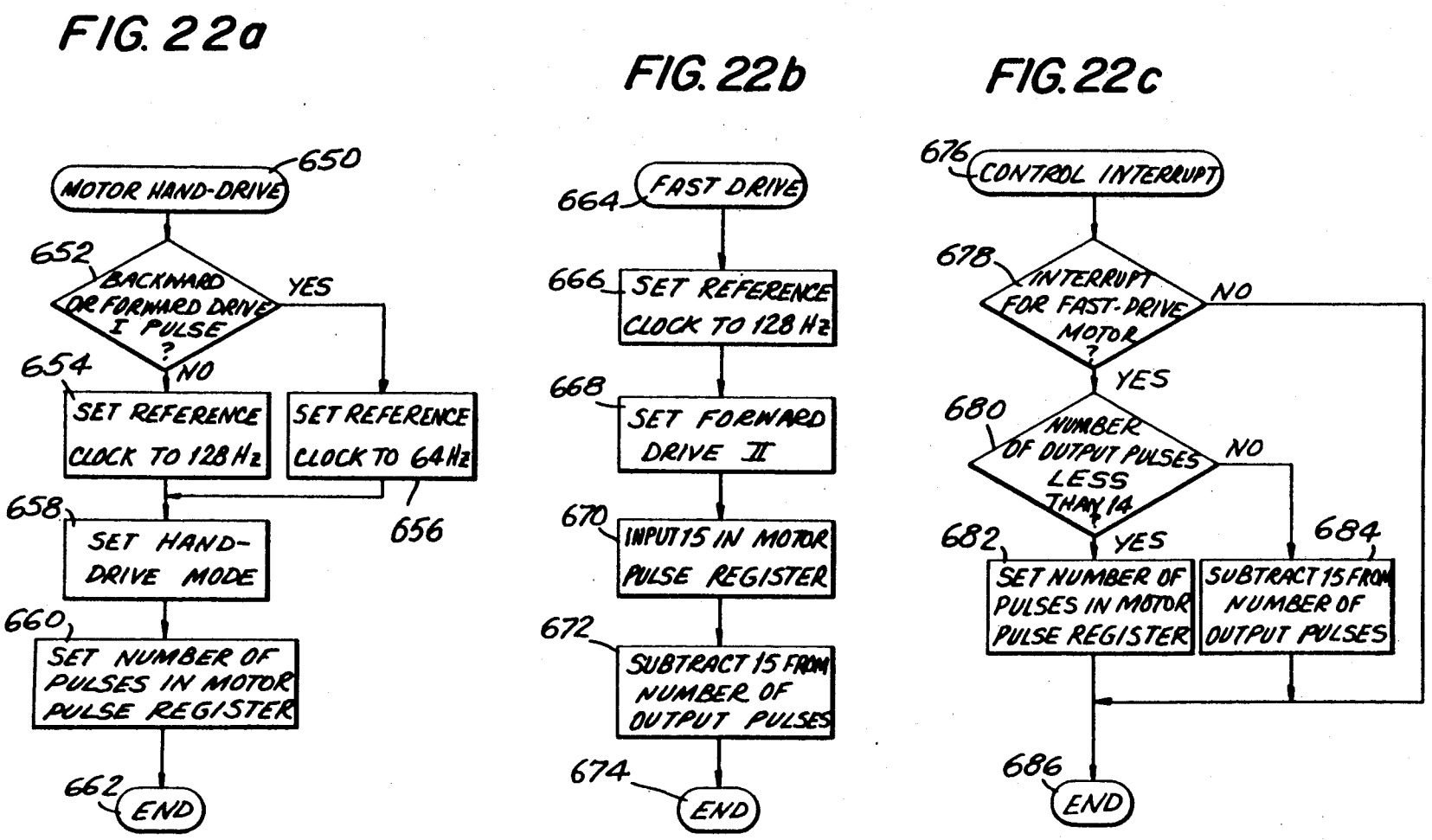
FIG. 22a
MOTOR HAND-DRIVE
650
BACKWARD OR FORWARD DRIVE I PULSE ?
652
YES
NO
SET REFERENCE CLOCK TO 128 Hz
654
SET REFERENCE CLOCK TO 64 Hz
656
SET HAND-DRIVE MODE
658
SET NUMBER OF PULSES IN MOTOR PULSE REGISTER
660
END
662
FIG. 22b
FAST DRIVE
664
SET REFERENCE CLOCK TO 128 Hz
666
SET FORWARD DRIVE II
668
INPUT 15 IN MOTOR PULSE REGISTER
670
SUBTRACT 15 FROM NUMBER OF OUTPUT PULSES
672
END
674
FIG. 22c
CONTROL INTERRUPT
676
INTERRUPT FOR FAST-DRIVE MOTOR ?
678
YES
NO
NUMBER OF OUTPUT PULSES LESS THAN 14 ?
680
YES
NO
SET NUMBER OF PULSES IN MOTOR PULSE REGISTER
682
SUBTRACT 15 FROM NUMBER OF OUTPUT PULSES
684
END
686

| NUMBER OF PULSES | REFERENCE CLOCK (Hz) |
|---|---|
| 15 | 16 |
| 15 | 25.6 |
| 15 | 32 |
| 15 | 42.7 |
| 15 | 51.2 |
| 15 | 64 |
| 15 | 85.3 |
| UP TO END | 128 |

| NUMBER OF PULSES | REFERENCE CLOCK (Hz) |
|---|---|
| 15 | 16 |
| 15 | 25.6 |
| 15 | 32 |
| 15 | 42.7 |
| 15 | 51.2 |
| UP TO END | 64 |

APPARATUS FOR ELECTRONICALLY CORRECTING AN ELECTRONIC TIMEPIECE

BACKGROUND OF THE INVENTION

The present invention relates to electronic correction or resetting of an electronic timepiece, and in particular, to electronically correcting or resetting the timepiece displays in a multishaft multifunctional analog timepiece.

Multishaft multifunctional analog watches have been corrected or reset electronically by electrically driving the hands at a constant fast speed to correct the alarm setting or the reference position of the chronograph hands. This is generally done by driving the hands at a constant speed by continuously actuating a push button switch which would drive the hands to be corrected at an accelerated constant speed.

These prior art electronically corrected electronic timepieces have been less than satisfactory. When the hands are driven at a constant fast speed, it is difficult for the user to stop the hands at the exact intended correction position. Accordingly, exact correction is not easily obtainable. If the correction speed is set at a slower constant speed, then a great deal of time is required to drive the hands to the intended corrected position when the hands are far from the intended position. In view of these disadvantages, users believe that electronically corrected timepieces are difficult to use and provide a disincentive for using such timepieces.

Accordingly it is desired to provide an improved electronically correcting electronic analog timepiece which may be corrected quickly and easily.

SUMMARY OF THE INVENTION

Generally speaking, in accordance with the invention, an improved electronically correcting electronic analog timepiece includes an analog display for displaying the time of day, and at least one additional analog display for displaying an alarm setting, timer or an analog chronographic display. Each analog display includes at least one hand which is driven by at least one step motor. A correction signal forming circuit provides drive pulses for driving the step motor for electrically correcting the time of day, alarm setting time, time period of the timer and chronographic setting. A control circuit causes the correction signal forming circuit to increase or decrease the driving speed of the hands in a step manner.

Accordingly, it is an object of this invention to provide an improved electronically correcting electronic timepiece.

Another object of this invention is to provide an electronic timepiece which is able to increase or decrease the driving speed of the hands in a step fashion through a correction signal formed during the correction process.

Yet another object of the invention is to provide an electronically correcting electronic analog timepiece which is easily and quickly electronically corrected.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combination of elements, and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a block diagram of a CMOS-IC for use in an electronically correcting electronic timepiece in accordance with the invention;

FIGS. 18*a*, 18*b* are flowcharts for indicating normal twelve hour time;

FIGS. 22*a*, 22*b* and 22*c* are flowcharts for driving the hands in the electronic timepiece;

DETAILED DESCRIPTION OF THE PREFERRED EMBODIMENTS

Figure 2:
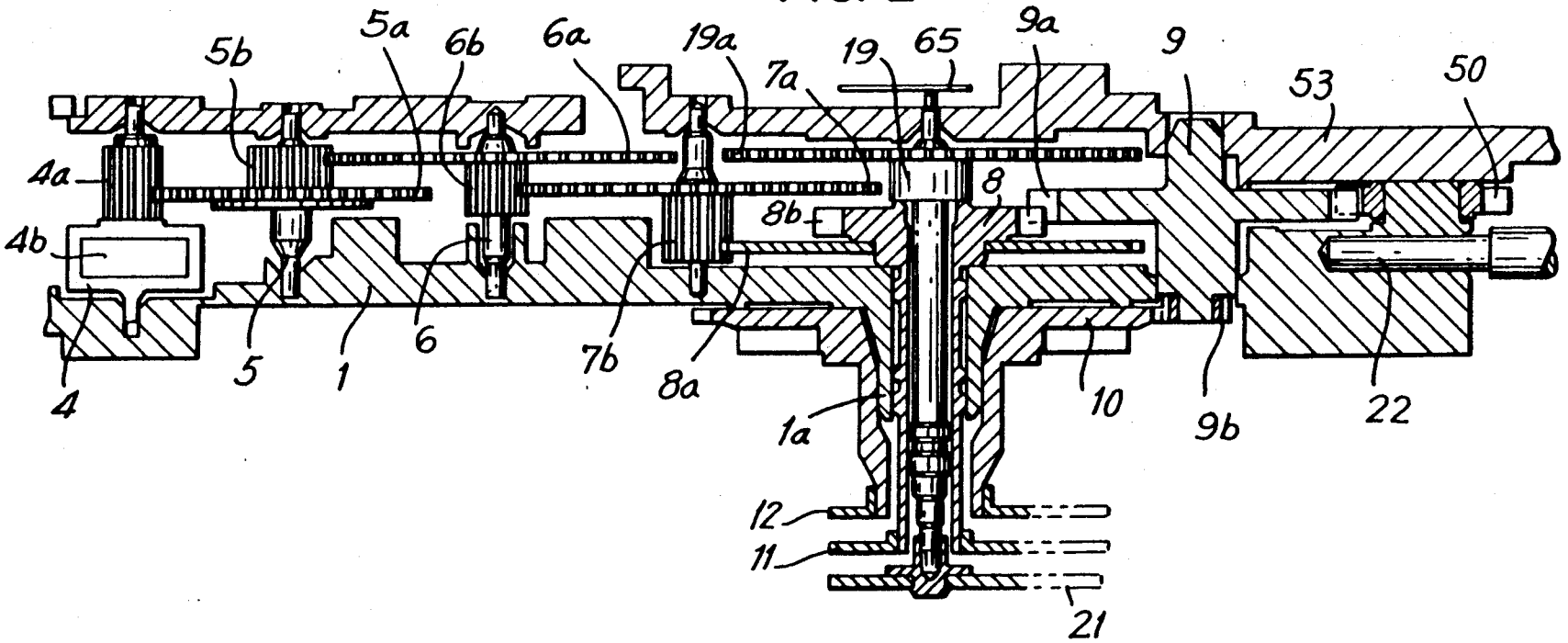
FIG. 2 is a sectional view of a wheel train for the hour and minute indicators for displaying normal twelve hour time constructed in accordance with the invention.
Figure 9:
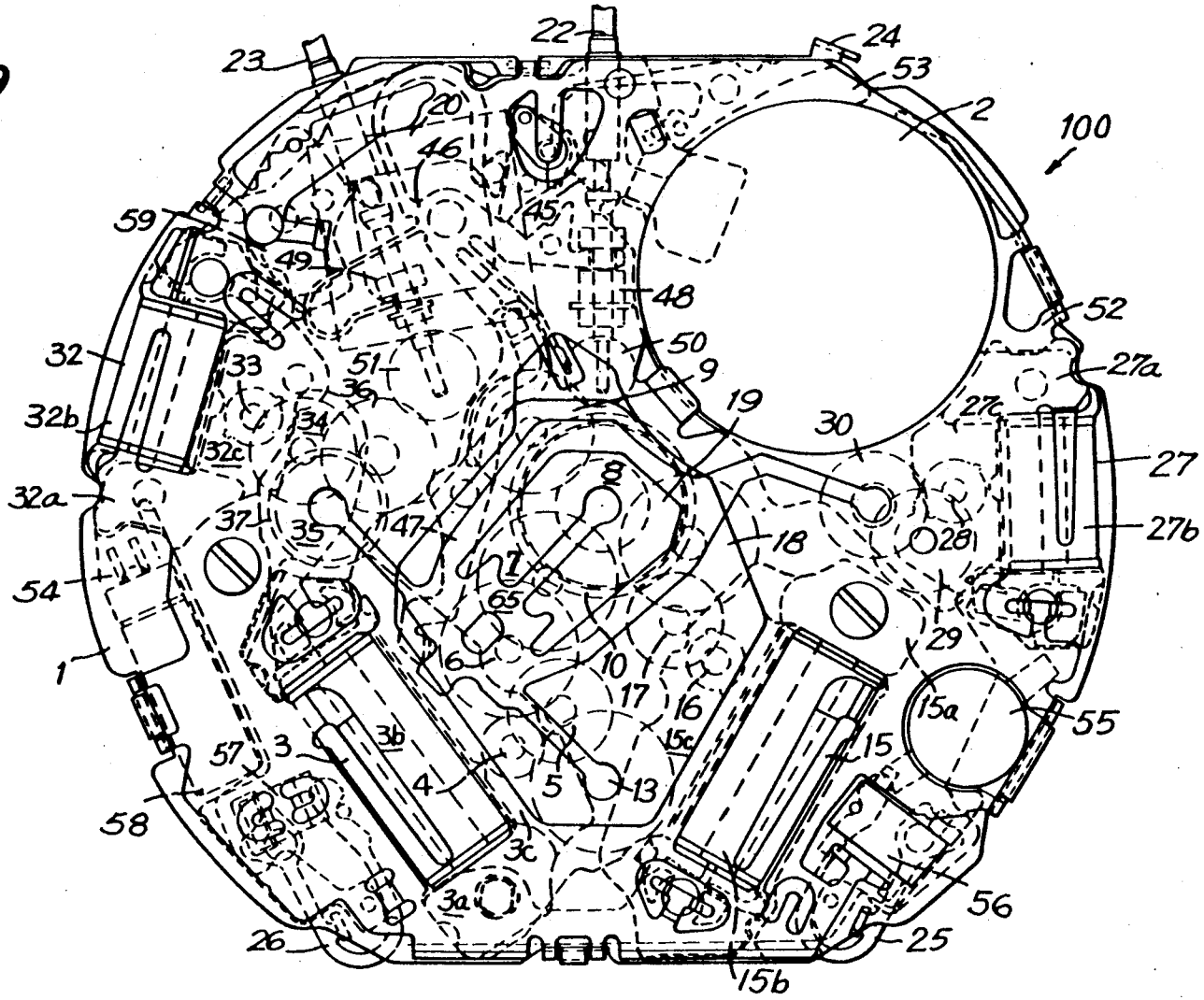
FIG. 9 is a bottom plan view of an electronic timepiece constructed in accordance with the invention.

Reference is first made to FIGS. 2 and 9 of the drawings wherein an electronically correcting electronic analog timepiece, generally indicated at 100, and constructed in accordance with the invention, is depicted. Electronic analog timepiece 100 includes a main plate 1 formed of resin molding with a battery 2 supported thereon. A first step motor A 3 supported on main plate 1 drives the normal twelve hour time display indicators. Step motor A 3 has a coil core 3*a* of a highly permeable material. A coil block 3*b* is made of a coil wound around coil core 3*a*. Step motor A 3 also includes a coil frame and coil lead substrate having opposed ends subjected to terminal processing by conducting electricity. A stator 3*c* is formed of a highly permeable material. A rotor 4 is rotatably supported on main plate 1 and includes a rotor magnet 4*b* and a rotor pinion 4*a*.

A fifth wheel 5 including a fifth gear 5*a* and a fifth pinion 5*b* is rotatably mounted between main plate 1 and a wheel train bridge 53. Similarly, a fourth wheel 6 having a fourth gear 6*a* and a fourth pinion 6*b*, a third wheel 7 having a third gear 7*a* and a third pinion 7*b* and a second wheel 8 having a second gear 8*a* and a second pinion 8*b* are each rotatably mounted between main plate 1 and wheel bridge 53. Second wheel 8 is formed as two distinct parts; second gear 8*a* being friction fit about second pinion 8*b*. A minute wheel having a minute gear 9*a* and a minute pinion 9*b* is rotatably mounted between main plate 1 and wheel bridge 53 while an hour wheel 10 having an hour gear 10*a* is rotatably mounted about a projecting portion 1*a* of main plate 1.

As seen in FIG. 2, the wheels mesh with each other to form a wheel train for driving the normal twelve hour time hour and minute indicators. Rotor pinion 4*a* meshes with fifth gear 5*a* while fifth pinion 5*b* meshes with fourth gear 6*a*. Fourth pinion 6*b* meshes with third gear 7*a* and third pinion 7*b* in turn meshes with second gear 8*a*. This wheel train arrangement is situated so that the minute and hour indication of normal twelve hour time is provided at the center of the timepiece movement.

A reduction in speed is realized between rotor 4 and second gear 8*a*. The speed reduction ratio of the wheel train is set at 1/1800. Thus, when rotor 4 is rotated at a speed of half a turn per second, second gear 8*a* is rotated once each 3,600 seconds, i.e. 360° each 60 minutes, enabling the indication of minutes for displaying normal twelve hour time. A minute hand 1 is fit over a distal end of second wheel 8 to provide the indication of elapsed minutes.

Additionally, second pinion 8*b* meshes with minute gear 9*a* and minute pinion 9*b* meshes with hour wheel 10. The speed reduction ratio realized from second pinion 8*b* to hour wheel 10 is set to be 1/12 to enable the indication of normal twelve hour time hours. An hour hand 12 is fit over a distal end of hour wheel 10 to indicate the hour of normal twelve hour time.

Figure 3:
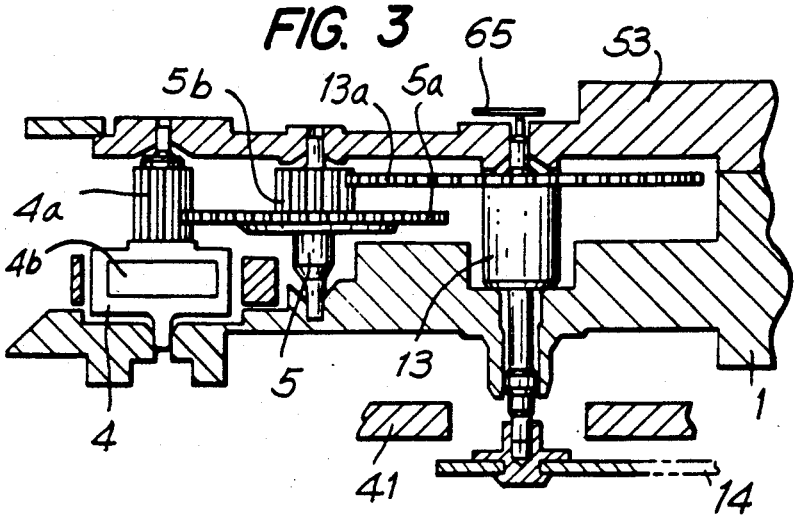
FIG. 3 is a sectional view of a wheel train for the seconds indicator for displaying normal twelve hour time constructed in accordance with the invention.

Referring now more particularly to FIGS. 3 and 9, a spindle is disposed within timepiece 100 in the general position of nine o'clock of the timepiece movement. A small second wheel 13 having a gear 13*a* is disposed on the spindle. Fifth pinion 5*b* meshes with small second gear 13*a*. Utilizing the train wheel arrangement of rotor 4 and fifth wheel 5, small second wheel 13 may be driven to provide an indication of normal twelve hour time seconds at a position at nine o'clock of the timepiece movement.

Again, the speed is reduced between rotor 4*b* and small second wheel 13 to display real time seconds. The speed reduction ratio between rotor pinion 4*a* and small second gear 13*a* is set at 1/30. Accordingly, when rotor 4 is rotated at a rate of 180° per second, small second wheel 13 makes a full revolution each 60 seconds, i.e., small second gear 13*a* rotates through 6° per second, thereby enabling the indication of the seconds for displaying normal twelve hour time. A small second hand 14 is fit over a distal end of the small second wheel 13 to indicate real time seconds.

A second step motor B 15 is provided for driving a chronograph second indicator. Step motor B 15 includes a coil core 15*a* formed of a highly permeable material. A coil block 15*b* is formed of a coil wound around coil core 15*a*. A coil lead substrate mounted about a coil frame has its opposite ends positioned to be subject to electrical conduction. A stator 15*c* is formed of a highly permeable material. A rotor 16 mounted between main plate 1 and wheel train 53 includes a rotor magnet 16*b* and a rotor pinion 16*a*.

Figure 4:
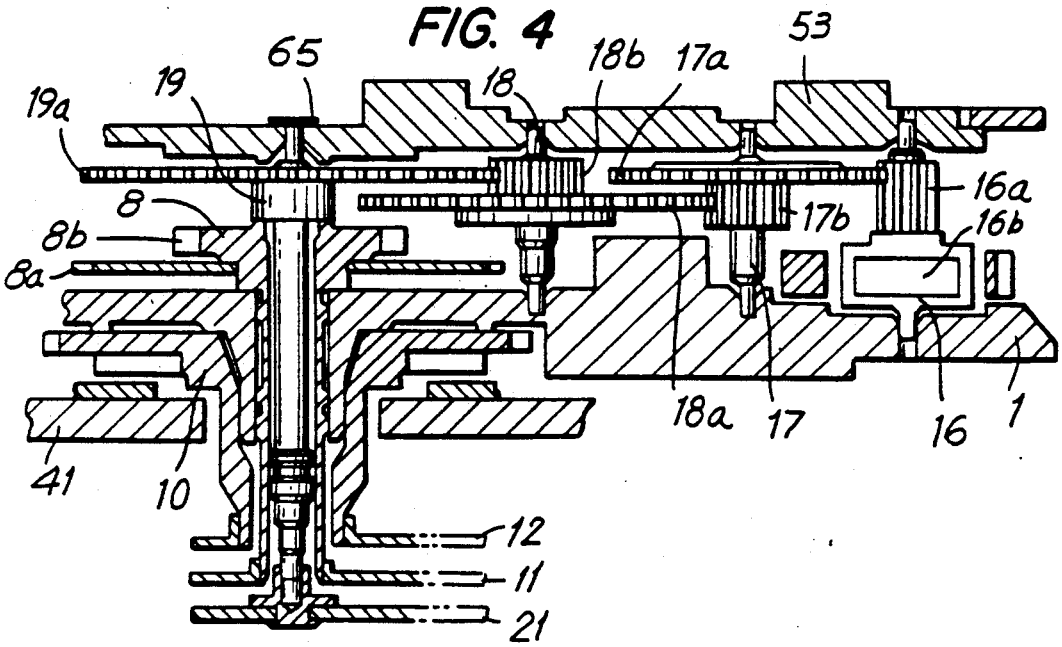
FIG. 4 is a sectional view of a wheel train for the indication of the chronographic seconds constructed in accordance with the invention.

As also shown in FIG. 4, a 1/5 second chronograph ("CG") first intermediate wheel 17 including a gear 17*a* and pinion 17*b* is rotatably mounted between main plate 1 and wheel bridge 53. Similarly, a 1/5 second CG intermediate wheel 18 having a second intermediate gear 18*a* and second intermediate gear 18*b* and a 1/5 second CG wheel 19 having a second CG wheel gear 19*a* are rotatably mounted between base 1 and wheel bridge 53.

Wheels 17, 18 and 19 mesh to form a wheel train for driving the chronograph second indicator. Rotor pinion 16*a* meshes with 1/5 second CG first intermediate gear 17*a* and 1/5 second CG first intermediate pinion 17*b* meshes with 1/5 second CG second intermediate gear 18*a*. 1/5 CG second intermediate pinion 18*b* meshes with 1/5 second CG gear 19*a*. 1/5 second CG wheel 119 is positioned at the center of the timepiece movement. With the above train arrangement, chronograph second indication is given at the center of the timepiece movement.

Again, the rotational speed is reduced between rotor 16 and 1/5 second CG wheel 19. The speed reduction ratio provided by the wheel train extending from rotor pinion 16*a* to 1/5 second CG gear 19*a* is set at 1/150.

An integrated circuit chip ("CMOS-IC") 20 for controlling the operation of electronic timepiece 100 is mounted on main plate 1. CMOS-IC 20 produces an electric signal rotating rotor 16 through 180° each 1/5 seconds. 1/5 second CG wheel 19 is rotated at a speed of 1.2° per fifth of a second, i.e., it rotates 1.2° by five steps each second, enabling the indication of chronograph seconds in units of 1/5 seconds. A 1/5 second CG hand 21 is fit over a distal end of 1/5 second CG wheel 19 to indicate the passing of chronograph seconds. 1/5 second CG hand 21 also serves as a timer setter hand for setting the timer time period.

Figure 5:
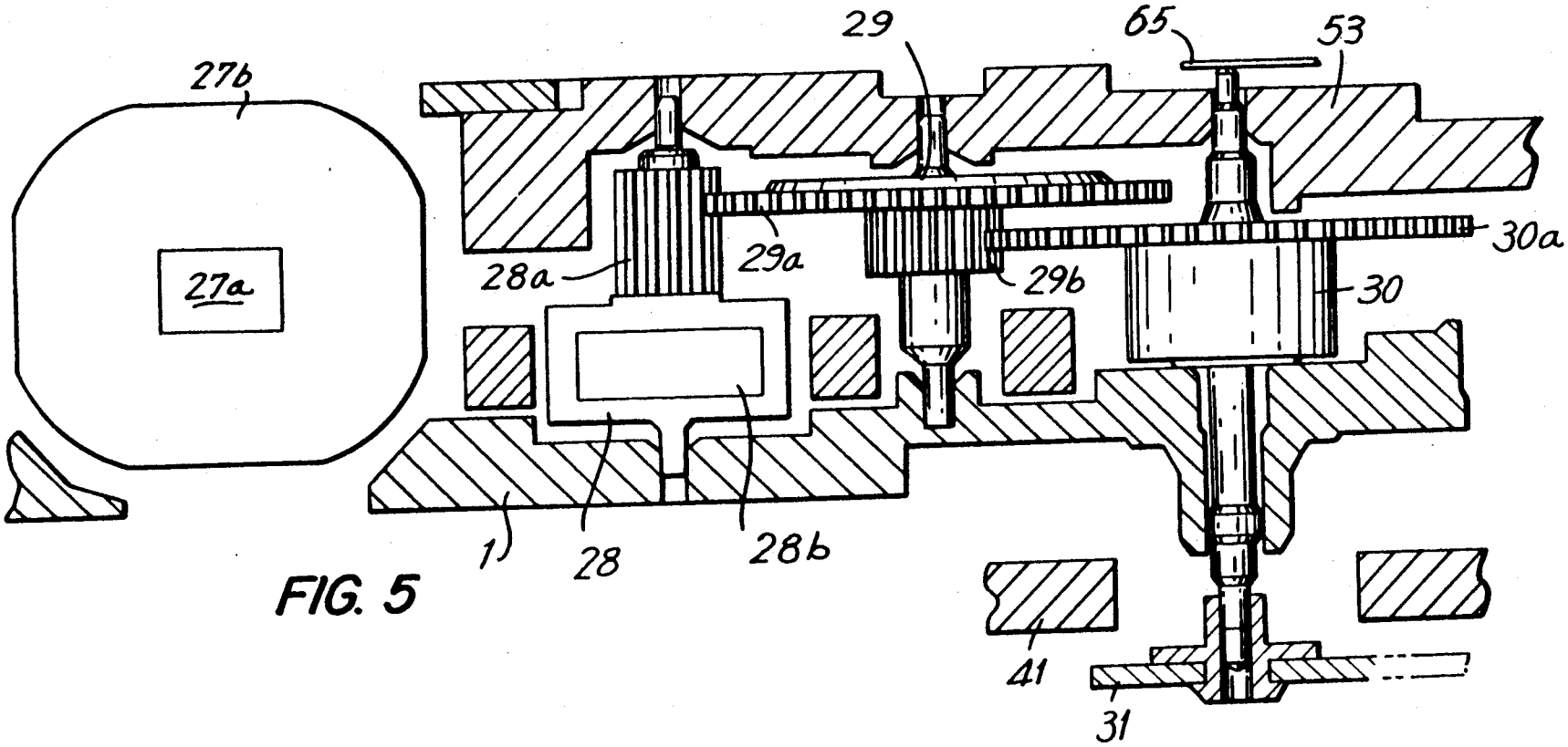
FIG. 5 is a sectional view of a wheel train for the indication of chronographic minutes and timer seconds constructed in accordance with the invention.

Reference is now made more particularly to FIG. 5 wherein a third step motor C 27 drives the indicator 4 indicating chronograph minutes and an indication of timer elapsed time seconds.

Step motor C 27 includes a coil core 27*a* formed of a highly permeable material and a coil block 27*b* formed by a coil wound around coil core 27*a*. A coil lead substrate having opposite ends operated on by conducting electricity through the terminals thereof is provided along with a coil frame. A stator 27*c* formed of a highly permeably material is magnetically coupled to a rotor 28 having a rotor magnet 28*b* and a rotor pinion 28*a*.

A minute CG intermediate wheel 29 having an intermediate gear 29*a* and intermediate pinion 29*b* is rotatably supported between wheel bridge 53 and main plate 1. A minute CG wheel 30 having a minute CG gear 30*a* is disposed in a spindle located at the twelve o'clock position of the timepiece movement. Rotor pinion 28*a* of rotor 28 meshes with minute CG intermediate gear 29*a*. Minute CG intermediate pinion 29*b* meshes with minute CG gear 30*a* providing a wheel train for the indication of chronographic minutes and elapsed time timer seconds. The train wheel construction allows both the chronograph minute indication and the timer elapsed time second indication to be performed on a spindle located at the twelve o'clock position of the time piece movement.

The speed is reduced between rotor pinion 28*a* and minute CG gear 30*a*. The speed reduction ratio is set at 1/30.

When electronic analog timepiece 100 is in a chronograph mode, CMOS-IC 20 produces an electric signal causing rotor 28 to be rotated at a rate 360° per minute, i.e. 180° times two steps. Therefore, minute CG wheel 30 rotates at a rate of 12° per minute, making a 360° rotation in thirty minutes enabling a chronographic minute indication of a thirty minute time period.

A minute CG hand 31 is fit over a distal end of minute CG wheel 30 to provide chronograph minute indication. Minute CG hand 31 working in combination with 1/5 second CG hand 21 permits chronograph indications ranging from a minimum readout of 1/5 seconds to a maximum readout of 30 minutes.

When in an elapsed time timer mode, CMOS-IC 20 provides an electric signal causing rotor 28 to be rotated in a direction opposite to the direction of rotation performed in the chronograph mode. The rotation of rotor 28 advances at a rate of 180° by one step per second. Minute CG hand 31 is rotated counterclockwise in one second units, thereby giving an indication of timer elapsed time seconds based upon one turn each sixty seconds.

Simultaneously, CMOS-IC produces an electric signal causing rotor 16 to rotate in a direction opposite to the chronographic mode at a rate of 180° by five steps per minute. Therefore, 1/5 second CG hand 21 is rotated counterclockwise at a rate of 6° per minutes giving the indication of timer elapsed minutes. The timer setting may be adjusted using a second winding stem 23 supported on main plate 1. When second winding stem 23 is held at a first step, each push of a switch B 25 rotates rotor 16 through 180° by five steps and 1/5 second CG hand 21 6° (1 minute units on the timepiece dial). Then, the elapsed time timer can be set within a maximum range of sixty minutes.

A step motor D 32 supported on main plate 1 drives the indicators for indicating the alarm ("AL") setting time. Step motor D 32 comprises a coil core 32*a* made of a highly permeable material. A coil block 32 is formed by a coil wound around coil core 32*a*. A coil frame and a coil lead substrate are provided, the coil lead substrate having opposite terminal ends subject to electric conductivity. A stator 32*c* is formed of a highly permeable material. A rotor 28 including a rotor pinion 33*a* and a rotor magnet 33*b* is rotatably supported on main plate 1.

An alarm intermediate wheel 34 having an intermediate wheel gear 34*a* and intermediate wheel pinion 34*b* and AL minute wheel 36 having an AL minute wheel gear 36*a* and AL minute wheel pinion 36*b* are rotatably supported between main plate and wheel bridge 53. AL center minute wheel 35 having an AL center minute gear 35*a* and an AL center minute pinion 35*b* and AL hour wheel 37 having an AL hour wheel gear 37 are supported on a spindle located at the six o'clock position of the timepiece movement.

Figure 6:
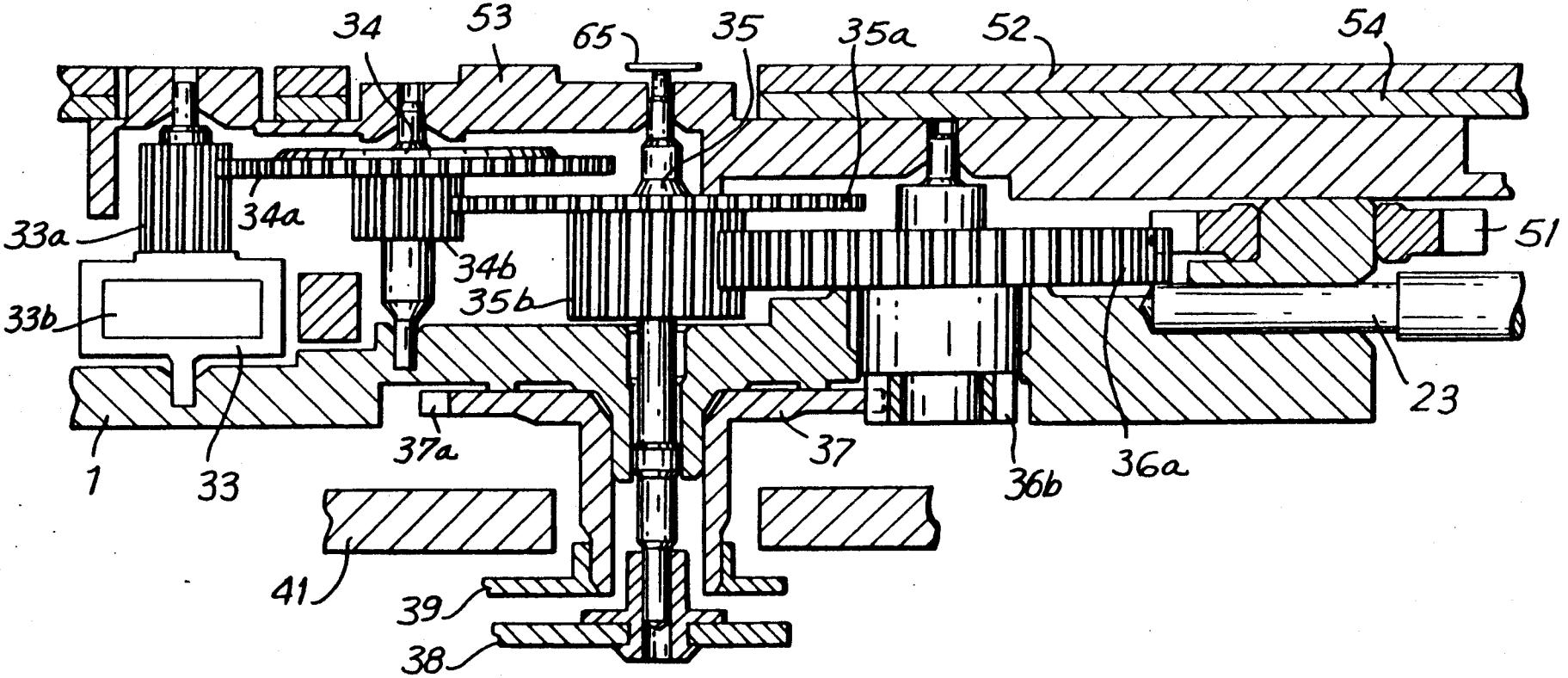
FIG. 6 is a sectional view of a wheel train for the indicator of the alarm set time constructed in accordance with the invention.

The above wheels form a wheel train providing an alarm setting and time indication on the spindle located at the 6 o'clock position of the timepiece movement. As seen in FIG. 6, rotor pinion 33*a* meshes with AL intermediate wheel gear 34*a* and AL intermediate wheel pinion 34*b* in turn meshes with AL center minute wheel gear 35*a*. AL center minute pinion 35*b* meshes with AL minute gear 36*a* and AL minute pinion 36*b* in turn meshes with AL hour wheel 37.

To control movement of the alarm setting time indicators, the wheel train reduces the rotation speed transmitted from rotor pinion 33*a* to AL center minute wheel gear 35*a*. The speed reduction ratio provided by the wheel train is set at 1/30 while the speed reduction ration provided by the wheel train from AL center minute wheel pinion 35*b* to AL hour wheel gear 37 is set to be 1/12. An AL minute hand 38 is fit over a distal end of AL center minute wheel 35 and an AL hour hand 39 is fit over a distal end of hour wheel 37.

The alarm time setting indicator is operated by setting a second winding stem 23 to a first step placing electronic timepiece 100 in an alarm on mode. CMOS-IC 20 provides an electric signal causing rotor 33 to be rotated through 180° each time a switch C 26 is pushed. Correspondingly, AL minute hand 38 is rotated through 6°, one minute on the dial, and AL hour hand 39 rotates through 0.5°. Therefore, the alarm time can be set between a range of one minute and 12 hours. By continuing to push switch C 26, AL minute hand 38 and AL hour hand 39 continuously run at an accelerating speed, so that the alarm time may be set in a short time. When the alarm setting time as indicated by AL minute hand 38 and AL hour hand 39 coincide with the indicated normal 12 hour time, an alarm is sounded. When second winding stem 23 is set to the zero step, electronic timepiece 100 is in an alarm off mode in which the AL minute hand 38 and AL hour hand 39 indicate the normal 12 hour time. When this occurs, CMOS-IC 20 produces an electric signal causing rotor 33 to be rotated through 180° per minute. Accordingly, the AL minute hand 38 is driven in minute unit increments.

In the above embodiments, no provision is made for electronic timepiece 100 to know the absolute position of the indicating hand. Therefore, manual operation for moving the hands to the reference position ("0-position correction") is required to return CG 1/5 second hand 21 and minute CG hand 31 to the twelve o'clock position when the chronograph and timer are reset, such as after replacement of a new battery. To obtain a 0-position correction of CG 1/5 second hand 21, CG 1/5 second hand 21 is moved in a forward direction by actuating a switch A 24 and in the backward direction by activating switch B 25 when first winding stem 22 is set at the first step. The 0-position correction of minute CG hand 31 is accomplished in the forward direction by activating switch A 24 and in the backward direction by activating switch B 25 with first winding stem 22 set at its first step.

Figure 8:
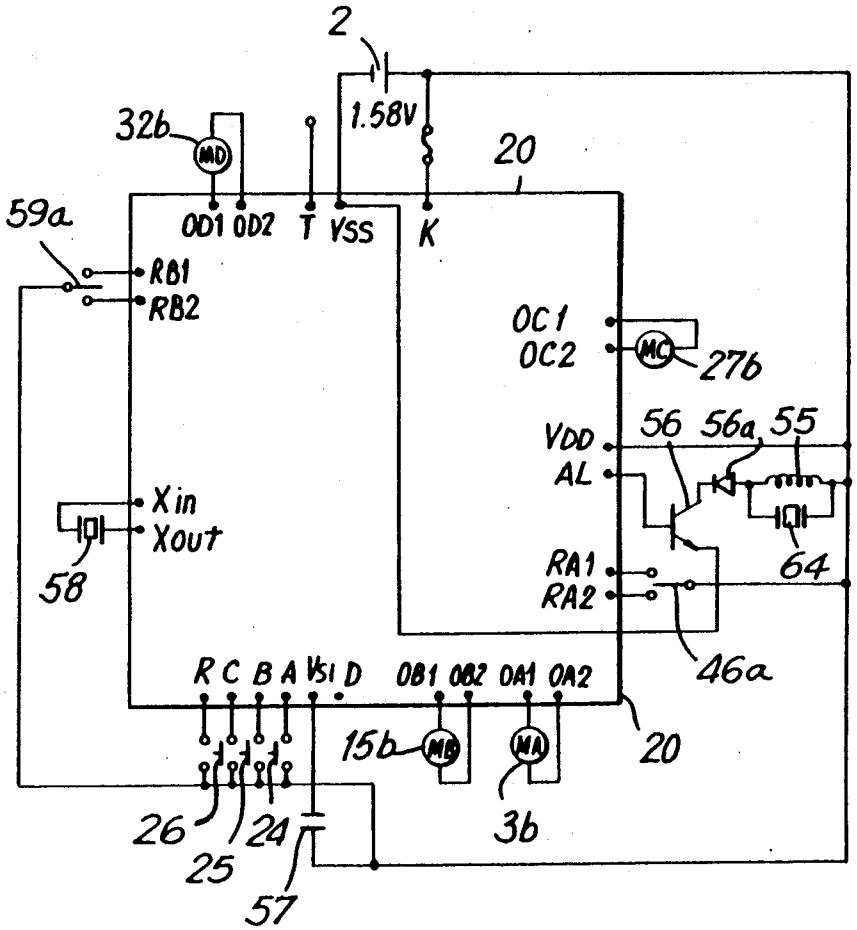
FIG. 8 is a circuit diagram of an electronic timepiece constructed in accordance with the invention.

Reference is now made to FIG. 8 in which a circuit diagram of the connection between CMOS-IC 20 and other electric elements of electronic timepiece 100 are provided. Silver oxide cell battery 2 provides power to CMOS-IC 20 at a terminal $V_{ss}$. Coil block 3*d* of step motor A 3 is coupled to CMOS-IC 20 at terminals OA1, OA2. Coil block 15*b* of step motor B 15 is coupled to CMOS-IC 20 at terminals OB1, OB2. Switch A 24, switch B 25 and switch C 26 are connected at input terminals A, B and C respectively. Coil block 27*b* of step motor C 27 is coupled to CMOS-IC 20 at terminals OC1, OC2. Coil block 32*b* of step motor D 32 is coupled at terminals OD1, OD2. A booster coil 55 provides an input to a minimolded transistor 56 having a protector diode 56*a* and are coupled to terminal AL for energizing a piezo-electric buzzer 64 connected across booster coil 55. A 0.1$\mu$ F chip capacitor 57 is coupled to CMOS-IC 20 for suppressing voltage fluctuations of a constant voltage circuit built within CMOS-IC 20. A tuning fork type micro-crystal oscillator 58 is coupled to CMOS-IC 20 at terminals $X_{in}$, and $X_{out}$ to provide a source for an oscillator circuit built in CMOS-IC 20. A switch 46*a* formed in a portion of yolk 46 (FIG. 9) is coupled to CMOS-IC 20 between terminals RA1, RA2. A switch 59*a* formed in a portion of second setting lever 23 is coupled to CMOS-IC 20 between terminals RB1, RB2.

Switches 24, 25 and 26 are each push button type switches that allow a user to apply an input therethrough only when they are pushed. Switch 46*a* is a switch which acts in cooperation with first winding stem 22 and is positioned so that terminal RA1 is closed when first winding stem 22 is set in its first step and closes terminal RA2 when winding stem 22 is in its second step. Switch 46*a* is opened when winding step 22 is at a normal position. Switch 59*a* acts in cooperation with second winding stem 23 and is arranged so that it closes terminal RB1 when second winding stem 23 is in a first step encloses terminal RB2 when stem 23 is at its second step. Switch 59*a* is open when stem 23 is set at a normal position.

Reference is now made to FIG. 1 in which a block diagram of CMOS-IC 20 is provided. CMOS-IC 20 is a micro-computer for controlling an analog electronic timepiece having a program memory 202, a data memory 204, four motor drives 213, 214, 215 and 216, a motor drive control circuit 212, a sound generator 210 and an interrupt control circuit 218 integrally formed by a single chip with a core CPU 201 at its center.

Core CPU 201 includes an alarm unit, a register for operation, an address control register, a stack pointer, an instruction register, an instruction decoder and other known structure. CPU 201 is connected to peripheral circuits to be described below through an address bus (adbus) and data bus (dbus) based on the memory map I/O technique. An address decoder 203 receives an input from CPU 201 and provides a decoded output to program memory 202. Program memory 202 is a program memory having a mask ROM of 2048 words by 12 bit configurations which stores the operating software for the integrated circuit. Program memory 202 provides an operation output for CPU 201. An address decoder 205 receives an output from CPU 201 along the adbus and provides a decoded output to data memory 204. Data memory 204 is a RAM of 112 words by four bits which is used as a timer for the various types of timer counting and as a counter for storing the position of the respective indicator hands. Data memory 204 provides an output and receives inputs from CPU 201 along the dbus.

An oscillator circuit 206 coupled to tuning fork type oscillator 58 at terminal $X_{in}$ and $X_{out}$ oscillates at a frequency of 32768 Hz. Oscillator circuit 206 produces an output signal $\phi$ 32K of 32768 Hz. A first frequency divider circuit 208 divides signal $\phi$ 32K and outputs signals $\phi$ 16 of 16 Hz. A second frequency divider circuit 209 successfully divides the signal $\phi$16 of 16 Hz into a signal $\phi$ 1 of 1 Hz. A signal $\phi$ 8 of 8 Hz is internally generated within second frequency divider circuit 209 and read by CPU 201 through BUS. An oscillation stop detector circuit 207 receives an input $\phi$ 1K produced by first frequency divider circuit 208 and detects the termination of oscillation by oscillation circuit 206 and resets CMOS-IC 20.

The status of respective frequency divider stage within the range from 8 Hz to 1 Hz can be read into core CPU 201 under the control of software. Furthermore, in this embodiment, the signal $\phi$ 16 of 16 Hz, the signal $\phi$ 8 of 8 Hz and $\phi$ 1 of 1 Hz are used as a time interrupt ("Tint") for performing processes such as time counting. Time interrupt Tint occurs upon a falling edge of each signal. Reading, resetting and masking are respective interrupt factors are all carried out under the control of the software such that resetting and masking can be independently affected for each of the interrupt factors.

A sound generator 210 receives inputs along the BUS and produces a buzzer drive signal output at terminal AL of CMOS-IC 20. The driver frequency, ON/OFF and sound patterns of the buzzer drive signal are controlled in accordance with the software transmitted along BUS.

A chronograph circuit 211 receives a $\phi$ 512 input at a terminal CP produced by first frequency divider circuit 208 to provide an output to control hand drive. Chronograph circuit 211 is arranged to control hand driving of a 1/100 second, greatly reducing the burden exerted on the software.

Figure 10:
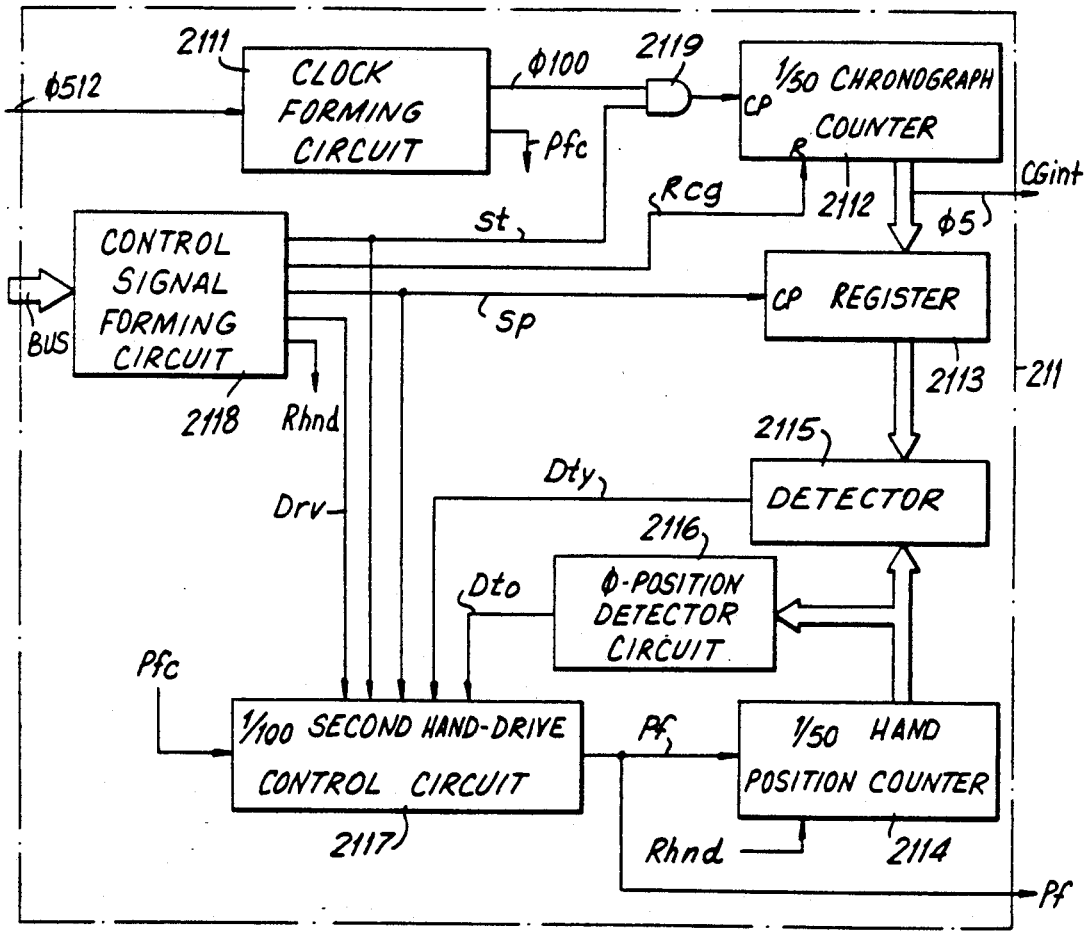
FIG. 10 is a block diagram of a chronograph circuit constructed in accordance with the invention.

Reference is made to FIG. 10 where a block diagram for a chronograph 211 is provided. A clock forming circuit 2111 receives signal $\phi$ 512 of 512 Hz produced by first frequency divider circuit 208 and produces a signal $\phi$ 100 of 100 Hz which acts as a reference clock for a chronographic time counting as well as clock pulse Pfc of 100 Hz and 3.91 ms pulse width which are utilized to form 1/100 second hand drive pulses Pf. A control signal forming circuit 2118 receives software commands along BUS and in response thereto produces a start signal St for commanding start/stop of chronograph time counting, a split signal Sp for commanding on/off switching of the script indication, a chronograph reset signal Rcg for resetting chronograph time counting, a 0-position signal Rhnd for storing the 0-position of the 1/100 second hand and a signal Drv for commanding operative/inoperative switching of the 1/100 second hand. AND gate 2119 receives the inputs of signal $\phi$ 100 and signal St and provides a gated output to a 1/50 chronograph counter 2112. 1/50 chronograph counter 2112 counts the signal $\phi$ 100 having passed AND gate 2119 and is reset by chronograph reset signal Rcg input at terminal R.

A register 2113 holds the contents of chronograph counter 2112 when control signal forming circuit 2118 outputs split indication command signal Sp. A 1/50 based hand position counter 2114 stores the indicated position of the 1/100 second hand by second drive control circuit 2117 and is reset in response to signal Rhnd output from control signal 2118 to store the 0-position of the 1/100 second hand.

Identity detector circuit 2115 compares the contents of register 2113 with the contents of hand position counter 2114 and outputs an identity signal Dty when the contents are identical. A 0-position detector circuit 2116 outputs a 0 detection signal Dto upon detecting 0 in the hand position counter 2114. When the contents of chronograph counter 2112 and hand position counter 2114 are identical during an operative state of the 1/100 second hand and chronographic time counting or when the contents of register 2113 and hand position counter 2114 differ during split indication and no time counting is occurring, or when the contents of 1/50 hand position counter 2114 is other than zero during the inoperative state of the 1/100 second hand and chronograph time counting occurs, 1/100 second hand drive control circuit 2117 passes clock pulses Pfc.

The 1/100 second hand can only be driven by step motor C 27. A carry signal $\phi$ 5 of 5 Hz output by chronograph counter 2112 causes a chronograph interrupt CGint with which the software is able to advance the processing of time counting by amounts greater than one fifth of a second.

Figure 11:
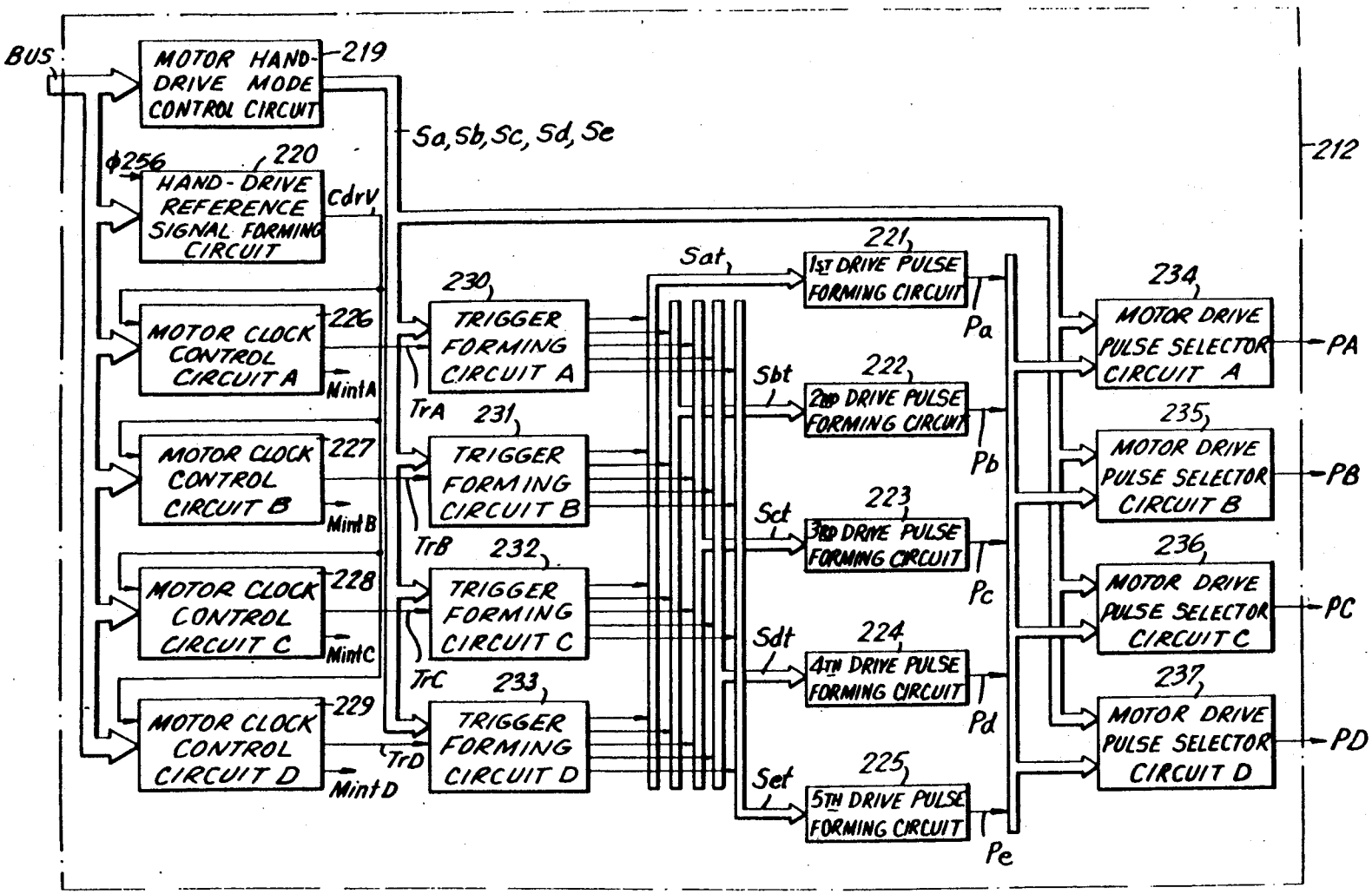
FIG. 11 is a block diagram of a motor hand drive control circuit constructed in accordance with the invention.

Returning to FIG. 1, a motor hand drive control circuit 212 is controlled by software commands received along BUS and provides outputs PA, PB, PC, PD for driving respective motor drives 213, 214, 215 and 216. As seen in greater detail in FIG. 11, motor drive control circuit 212 includes a motor hand drive mode control circuit 219 which stores hand drive mode of respective motors. Motor hand drive mode control circuit 219 forms and outputs respective control signals Sa, Sb, Sc, Sd and Se in response to software input transmitted along BUS. Control signal Sa selects forward drive I. Control signal Sb selects forward drive II. Control signal Sc selects backward drive I. Control signal Sd selects backward drive II and control signal Se selects forward correction drive. A hand drive reference signal forming circuit 220 receives software command input along BUS and forms hand drive reference clock signal Cdrv in response thereto.

Figure 17:
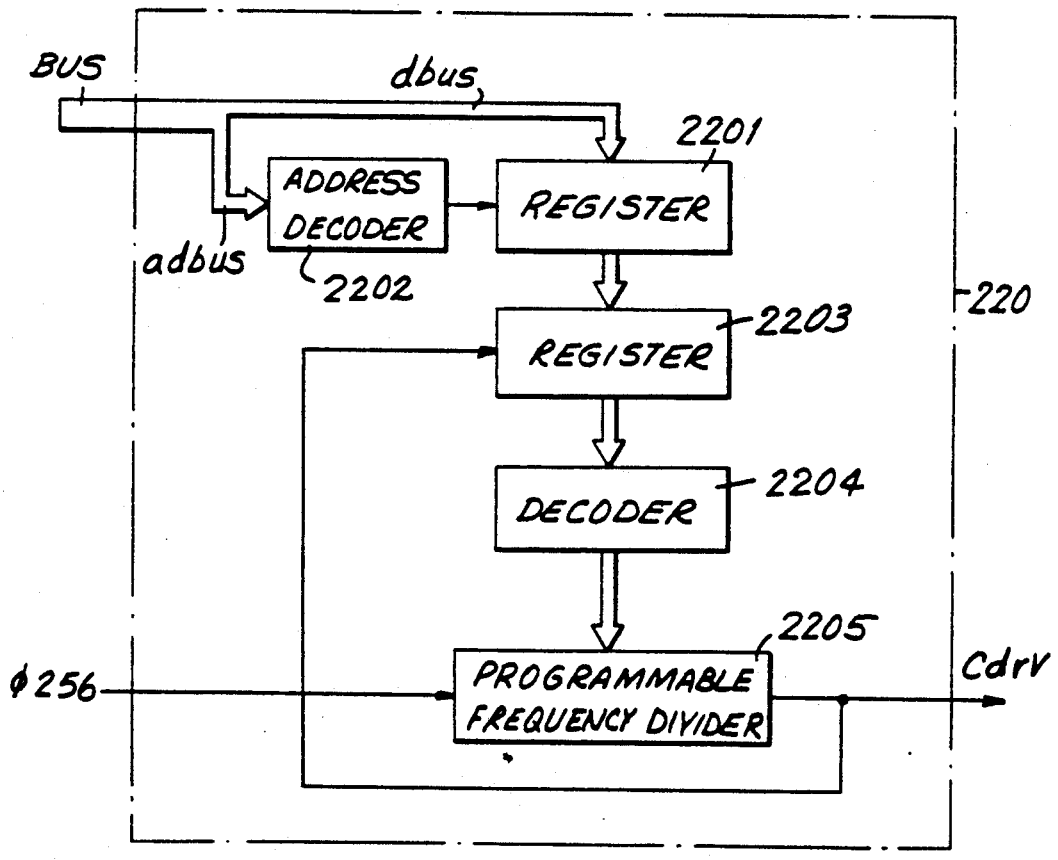
FIG. 17 is a block diagram of a hand drive standard signal forming circuit constructed in accordance with the invention.

As seen in FIG. 17, hand drive reference signal forming circuit 220 includes a programmable frequency divider 2205 which receives input $\phi$ 256 having 256 Hz output by first frequency divider 208 and forms a signal having a frequency 1/n the input frequency and outputting this signal as reference clock Cdrv. A three bit register 2201 stores data input from dbus for determining the frequency of the hand drive reference clock Cdrv. An address decoder 2202 receives software command along adbus and provides an output command signal to three bit register 2201 for determining the frequency of hand drive reference clock Cdrv. A three bit register 2203 receives data stored in register 2201 upon each falling edge of hand drive reference clock Cdrv output by programmable frequency divider 2205. A decoder 2204 outputs the numbers 2, 3, 4, 5, 6, 8, 10, 16 in binary notation corresponding to data stored in register 2203. Programmable frequency divider 2205 divides the input $\phi$ 256 signal in accordance with the output of decoder 2204 producing clock Cdrv.

In response to software commands, hand drive reference signal forming circuit 220 can select any on of eight values to be the frequency of hand drive reference clock Cdrv, specifically, 128 Hz, 85.3 Hz, 64 Hz, 81.2 Hz, 42.7 Hz, 32 Hz, 25.6 Hz, and 16 Hz. Changing the frequency of hand drive reference clock Cdrv is done when the data is input into register 2203. Data is input into register 2203 in synchronism with the output of hand drive reference clock Cdrv. An interval of 1/fa has to be utilized in changing the previous frequency fa of hand drive reference clock Cdrv to subsequent frequency Fb. When forward drive I and backward drive are carried in succession, the frequency of hand drive reference clock Cdrv is limited to less than 64 Hz.

Figure 16:
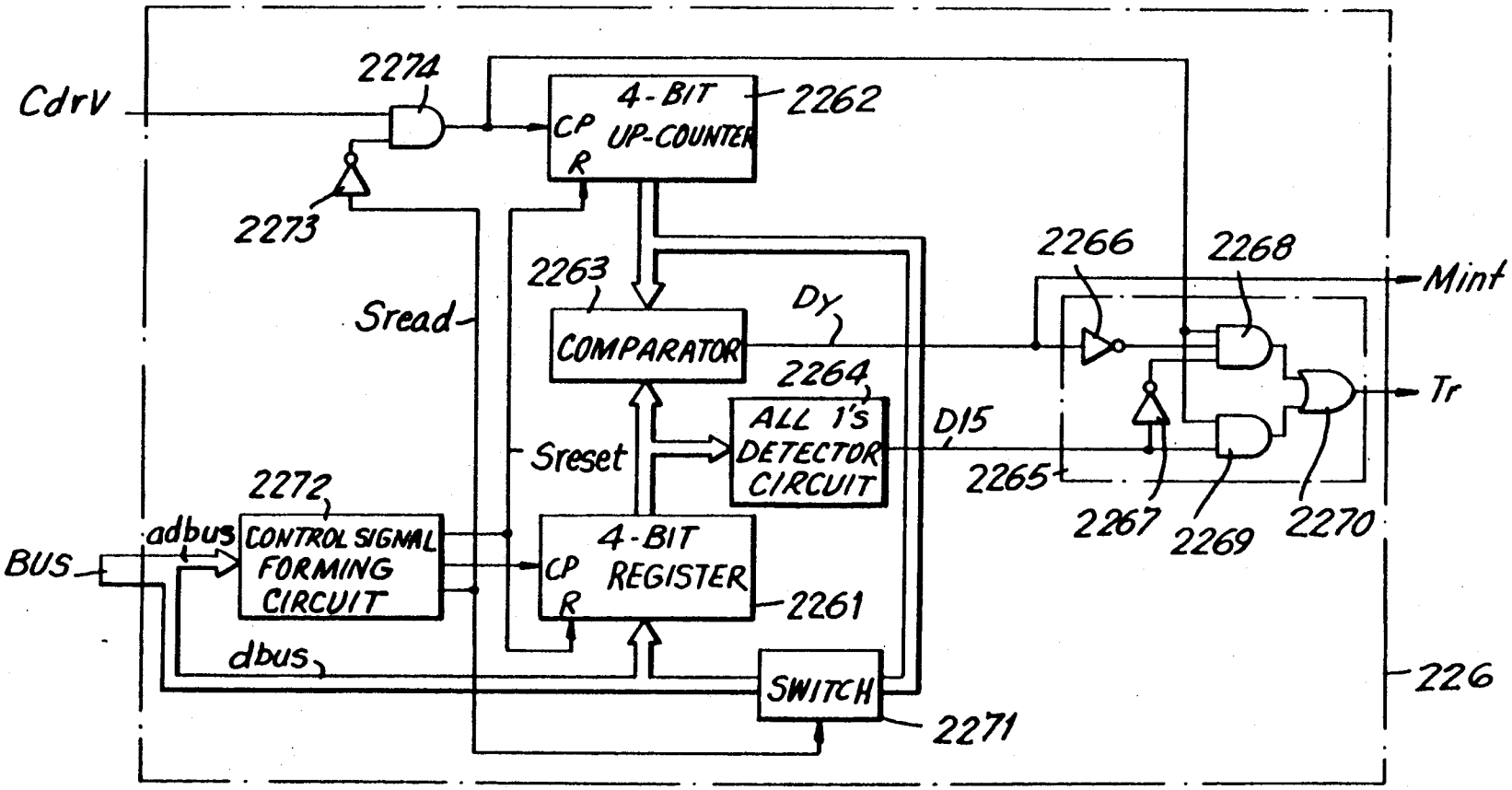
FIG. 16 is a block diagram of a motor clock control circuit constructed in accordance with the invention.

Returning to FIG. 11 motor clock control circuits 226, 227, 228 and 229 are motor clock control circuits for controlling the number of hand drive pulses supplied to respective step motors A 3, B 15, C 27 and D 32 in response to commands from the software input along BUS and hand drive reference clock Cdrv. As seen in FIG. 16, each motor clock control circuit 226–229 includes a control signal forming circuit 2272 which in response to software commands input along adbus outputs a signal Set, a signal Sread and a signal Sreset. A four bit register 2261 stores the number of hand drive pulses provided by the software input along dbus. An AND gate 2274 receives hand drive reference clock Cdrv and an inverted Sread signal from inverter 2273 and produces a gated hand drive reference clock Cdrv. A four bit up counter 2262 counts the gated hand drive reference clock Cdrv and is reset by control signal Sreset. Identity detector 2263 compares the coincidence between the contents of register of 2261 and four bit up counter 2262. Identity detector 2263 outputs identity signal Dy upon detecting an identity between the contents. An all 1s detector circuit 2264 outputs an all 1s detection signal D15 when the contents of register 2261 is all 1s.

A trigger signal generator 2265 includes an invertor 2266 which receives signal Dy and provides a first input to AND gate 2268. An invertor 2267 receives signal D 15 and provides an inverted input to AND gate 2268. AND gate 2268 also receives the gated hand reference clock Cdrv and provides an output to an OR gate 2270. A second AND gate 2269 receives the gated hand drive reference clock Cdrv and signal D15 as input and provides a second input to OR gate 2270 which produces an output Tr as the output of trigger signal generator 2265.

When all 1s are present in register 2261, motor pulses continue to be output repeatedly until different data is input. When data other than all 1s is input into register 2261, motor pulses are output a number of times corresponding to that data and then stopped until the data is reset. A bi-directional switch 2271 is turned on upon the output of control signal Sread or placing the data stored in up counter 2262 onto data buses. Control signal forming circuit 2227 produces signal Sset for setting the number of hand drive pulses in register 2261, signal Sread for reading the data in up counter 2262 and signal Sreset for resetting register 2261 and up counter 2263.

When Sread is output, the gate combination of invertor 2273 and AND gate 2274 inhibits the passage of hand drive reference clock Cdrv. It is then required to generate the signal Sreset for resetting register 2261 and four bit up counter 2262 after reading. Also, when identity detector circuit 2263 detects a coincidence between the contents of register 2261 and four bit up counter 2262, a motor control interrupt Mint signal is produced. When the motor control is generated, the software can read which interrupt has been generated and then reset in accordance with this read value.

Reference is again made to FIG. 11 in which trigger generator circuits 230, 231, 232 and 233 produce trigger signals Sat, Sbt, Sct, Sdt and Set in response to the trigger signals output by respective motor clock control circuits 226-229 and the hand drive mode control signals Sa, Sb, Sc, Sd and Se output by motor hand drive mode control circuit 219.

Figure 12:
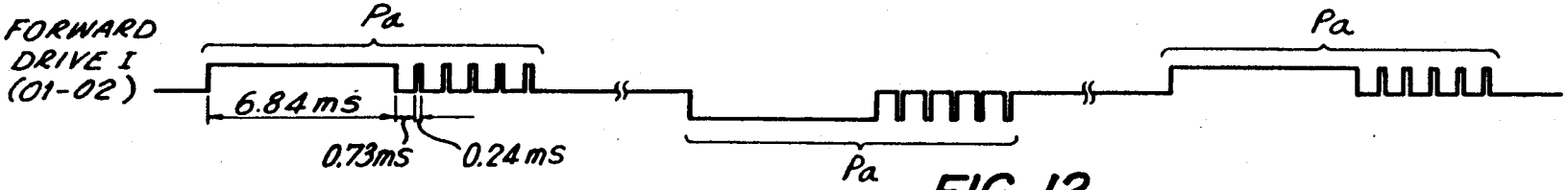
FIG. 12 is a timing chart of motor drive pulses produced by a first drive pulse forming circuit constructed in accordance with the invention.
Figure 13:
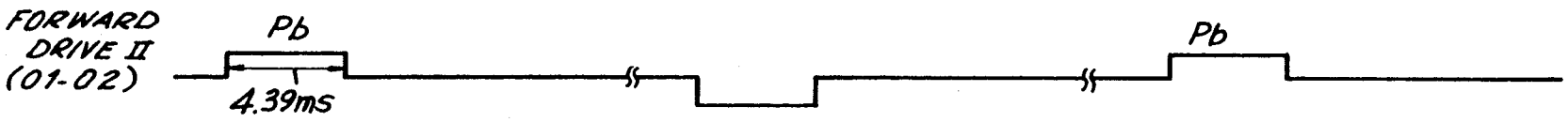
FIG. 13 is a timing chart of motor drive pulses produced by a second drive pulse forming circuit constructed in accordance with the invention.
Figure 14:
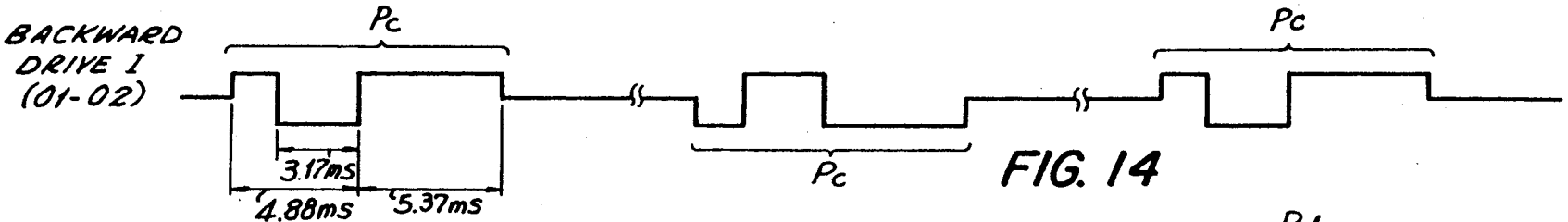
FIG. 14 is a timing chart of motor drive pulses constructed in accordance with a third drive pulse forming circuit constructed in accordance with the invention.
Figure 15:
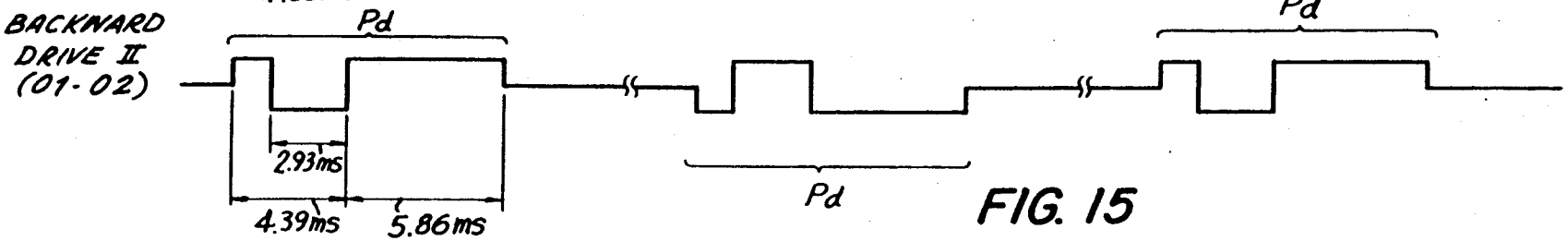
FIG. 15 is a timing chart of motor drive pulses produced by a fourth drive pulse forming circuit constructed in accordance with the invention.

A first drive pulse forming circuit 221 receives trigger signal Sat and outputs drive pulses Pa for forward drive I as shown in FIG. 12. A second drive pulse forming circuit receives trigger signal Sbt and outputs drive pulses Pd for forward drive II as shown in FIG. 13. A third drive pulse forming circuit 223 receives an input of Sat and outputs drive pulse Pc for backward drive I as shown in FIG. 14. A fourth drive pulse forming circuit 22 receives trigger signal Sdt and outputs drive pulses Pd for backward drive II as shown in FIG. 15.

A fifth drive pulse forming circuit 225 receives trigger signal Set and output pulses Pe for compensating motor driving by changing the pulse width in response to the load. Pulses Pe would include normal drive pulses P1, correction drive pulses P2, pulses P3 formed upon detection of the AC magnetic field, AC magnetic detection pulses Sp1 and rotation detecting pulses Sp2 as disclosed in Japanese Patent Laid-open No. 60-250883.

Motor drive pulse selectors 234, 235, 236 and 237 receive drive pulses Pa, Pb, Pc, Pd and Pe and control signals Sa, Sb, Sc, Sd and Se to output drive pulses necessary for the associated step motors. Motor drive pulse selector circuits 234, 235, 236, 237 select the appropriate pulses necessary for the associated step motor from the motor drive pulses Pa, Pb, Pc, Pd and Pe in response to drive mode control signals Sa, Sb, Sc, Sd and Se. Accordingly, motor drive pulse selector circuit A 234 produces a motor drive pulse PA, while motor drive pulse selector circuit B 235 produces a motor drive pulse PB, motor drive pulse selector C 236 produces a motor drive pulse PC and motor drive pulse selector circuit D 237 produces a motor drive pulse PD.

Returning particularly to FIG. 1, a motor drive A 213 receives input PA and provides motor drive pulses through terminals OA1, OA2 to coil 3*b* of step motor A 3. A motor drive B 214 receives signal PD and produces a motor drive pulse through terminals OB1, OB2 to coil 15*b* of step motor B 15. Motor drive C 215 receives an input PC and Pf from chronograph circuit 211 and produces a motor drive pulse through terminals OC1, OC2 to coil 27*b* of step motor C 27. Motor drive D 216 receives an input PD and provides a motor drive pulse across output terminals OD1, OD2 to coil 32*d* of step motor D 32.

An input control and reset circuit 217 processes respective switch inputs applied through terminals A, B, C, D, RA1, RA2, RB2 and processes respective input applied through input terminals K, T and R. An input is applied through any of switch terminals A, B, C, D or any one of switch terminals RA1, RA2 and RB1, RB2 and a switch interrupt Swint is output. When this occurs, interrupt factors are read and reset in accordance with controls provided by the software. Each input terminal is normally brought to $V_{ss}$ and the data is set at 0 when in the open state and is set to 1 when connected to $V_{dd}$.

Terminal K is a specification switching terminal which allows the selection of either one of two types of specification as dependent on data applied at terminal K. The reading of data at terminal K is executed under control of the software. Terminal R is a system reset terminal. When terminal R is connected to $V_{DD}$, the hardware is forced to initialize core CPU 201, frequency divider circuits 208, 209 and the other peripheral circuits.

Terminal T is a test mode conversion terminal. When the clock is input to terminal T with RA2 terminal kept connected to $V_{DD}$, the peripheral circuit can be tested in any one of 16 test modes. The principle test modes include a forward drive I verification mode, a forward drive II verification mode, a backward drive I verification mode, a backward drive II verification mode, a correction drive verification mode and a chronograph 1/100 second verification mode. In these verification modes, the relevant motor drive pulses are automatically issued to the output terminal of the respective motor drive pulses.

System reset can also be affected with simultaneous application of switch inputs other than connecting terminal R2 to $V_{DD}$. The present integrated circuit is arranged so that a system reset may be forcibly implemented by the hardware upon simultaneous input through inputs A and C, B and RA2, as well as through any one of A, B and C, RA2 and RB2. There is also a frequency divider circuit reset and a peripheral circuit reset as reset functions which can be processed under software control. When the peripheral circuit reset is performed, the frequency divider circuits are reset.

An interrupt control circuit 218 receives each interrupt signal, Tint, CGint, Mint, Swint and in response to software control inputs and an input from input control and reset signal forming circuit 217, prioritizes the respective interrupts. These include storage of the interrupts until reading, reset after reading with respective switching interrupts, chronograph interrupts and motor control interrupts. A constant voltage circuit 200 forms a low constant voltage of about 1.2 volts from the voltage of battery 2, about 1.58 volts, applied between $V_{DD}$ and $V_{SS}$ and then outputs to the $V_{s1}$ terminal.

By constructing an integrated circuit as described above for driving a step motor, an integrated circuit is provided which has motor drivers able to drive four step motors simultaneously. By including a motor hand drive mode control circuit, drive pulse forming circuit and motor drive pulse selector circuits the energizing of four step motors may be accomplished in any one of three forward drive modes and two backward drive modes independently under the control of the software. Additionally, by providing a hand drive reference signal forming circuit the hand drive speed of each step motor can be freely changed. By providing four motor clock forming circuits corresponding to four step motors in a one to one relation, the number of hand drive pulses for driving each motor may be freely set under the control of the software.

Figure 7:
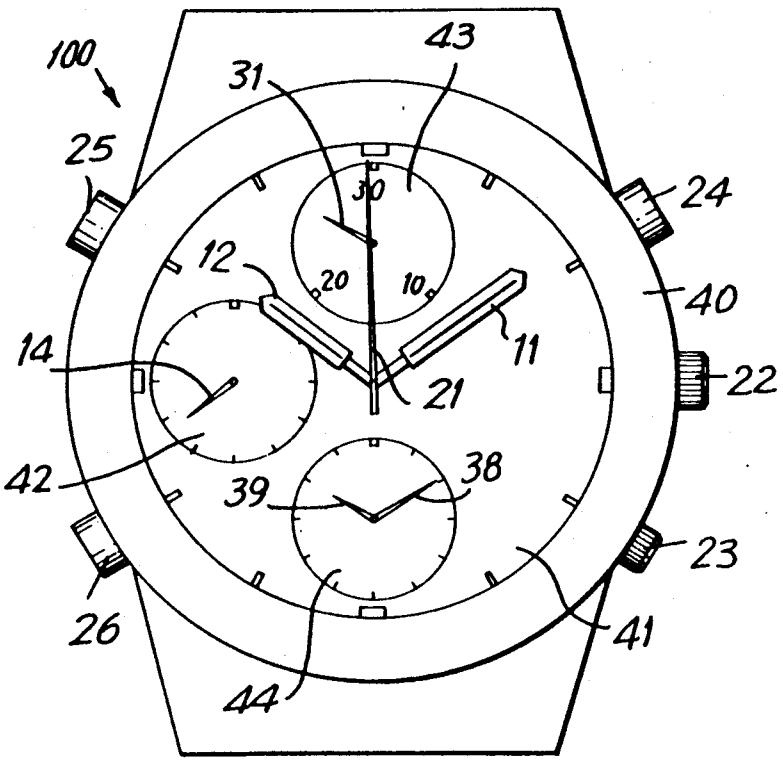
FIG. 7 is a plan view of the face of an electronic analog timepiece constructed in accordance with the invention.

Reference is now made to FIG. 7 wherein a top plan view of electronic analog timepiece 100 is provided. Electronic analog time piece 100 includes a bezzle case 40 and a dial 41 provided within bezzle case 40 to provide a watch face. An area 42 of dial 41 provides indication of normal 12 hour time seconds. An area 43 of dial 41 indicates chronograph minutes and the elapsed seconds of the timer. An area 44 of dial 41 provides indication of the alarm setting time. Normal 12 hour time is indicated utilizing small second hand 14 driven in units of seconds, minute hand 11 and hours hand 12 as described above.

Adjustment of the normal 12 hour time is made by withdrawing first winding stem 22 to the second step. As shown in FIGS. 2 and 9, in this position, fourth wheel 6 is restricted by the train wheel setting lever 47 which engages with setting lever 45 and yoke 46 stopping rotor 4 to suspend drive motion of small second hand 14. On rotating the first winding stem about its axis, winding torque is transmitted to minute 9 through a sliding pinion 48 and a setting wheel 50. Because second gear 8*a* is slideably coupled to second pinion 8*b*, setting wheel 50, minute wheel 9, second pinion 8*b* and hour wheel 10 are all rotatable even when fourth wheel 6 is restricted in motion. Accordingly, minute hand 11 and hour hand 12 can be rotated allowing the user to set those hands to any desired time.

Reference is now made to FIG. 18 in which a flow chart for indicating normal twelve hour time by electronic timepiece 100 is provided. A 1 Hz interrupt is input in accordance with a step 500 causing CPU 201 to determine whether switch 46*a* is off or on at terminal RA2 in a step 502. If switch 46*a* is off at terminal RA2, then a forward compensation driving control signal for step motor A 3 is output by motor hand drive mode control circuit 219 of motor drive control circuit 212 and a forward correction drive for motor A 3 is performed in a step 504. In a step 506, the number of hand drive pulses is set to 1 in the motor clock control circuit A 226.

If switch 46*a* is on at terminal RA2, such as in a time correction state, then the motor driving is stopped in accordance with a step 510. If switch 46*a* is on a terminal RA2 and there is a switch input in a step 512, such as during a time correction state, then switch 46*a* is turned off at terminal RA2 in accordance with a step 514. Both frequency divider circuit 208 and 209 are then instantaneously reset so that the motor will be driven after a one second interval in accordance with a step 516.

Figure 19B:
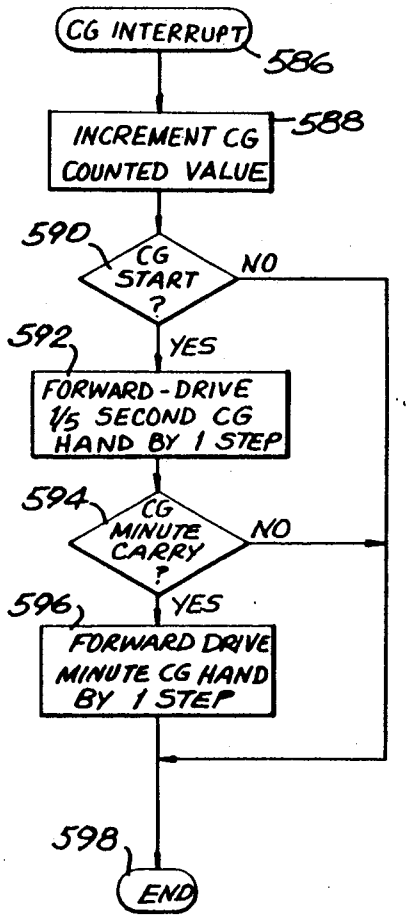
FIGS. 19*a*, 19*b* are flowcharts for providing chronographic operation of the electronic timepiece.
Figure 19A:
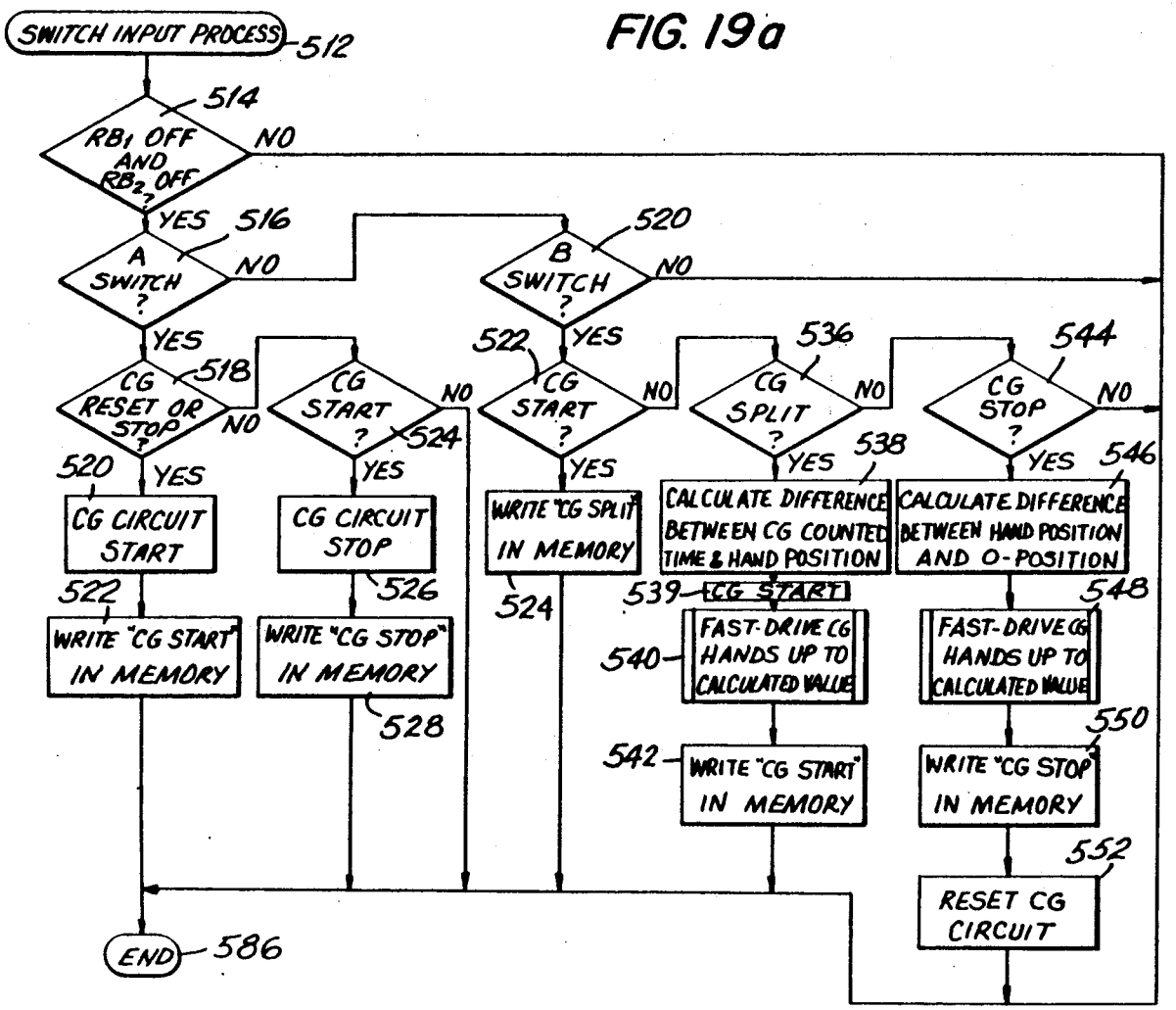

Reference is now made to FIG. 19 in which a flow chart for operating the electronic analog timepiece 100 in a chronographic mode is provided. Second winding stem 23 is set at its normal position operating switch 59*a* in accordance with a step 512 so that switch 59*a* is off at both terminals RB1, RB2 in accordance with a step 514. This places electronic analog timepiece 100 in a chronographic mode. By depressing switch A in a step 516, the chronograph may be ultimately stopped or reset in a step 518 or started in a step 524. If the chronograph has been stopped or reset the chronograph circuit is started in a step 520 and the occurrence of "CG start" representing the state in which the chronograph counts time and the split indication is generated within chronograph circuit 211 is written within data memory 204 in a step 522.

To start a chronograph counting a CG interrupt signal CGint is produced by chronograph circuit 211 in a step 586. Upon each CG interrupt, the CG 1/5 second counter formed in a portion of data memory 204 is incremented by 1 in a step 588. The chronograph count and the split commanded again produced in accordance with a step 590. 1/5 second CG Hand 21 is driven forward by one step equal to one fifth of a second in a step 592. It is determined whether the 1/5 second counter has counted one minute in a step 594. Whenever the 1/5 second counter has counted one minute, a CG minute counter also formed in a portion of data memory 204 is incremented by one and CG hand 31 is driven forward one minute in a step 596. Upon completion of the process, the process is ended in a step 598. CG circuit 211 is stopped in a step 526 and "CG stop" is written in the memory in step 528.

If the B switch is activated in a step 520 then the chronograph again enters the CG start status in a step 522 and writes "CG split" in the memory in a step 524. If the B switch is activated and the electronic analog timepiece 100 is only in split status in accordance with a step 536, the difference between the chronograph counted time and the hand position is calculated in a step 538. A CG start mode is produced in a step 539 to fast drive both the 1/5 second CG hand 21 and a minute CG hand 31 to indicate the calculated value which is the counted time in a step 540. The "CG start" is then written in data memory 204 in a step 542.

If the B switch is applied when electronic analog timepiece 100 is not in a chronographic time counting mode, such as when chronographic function has stopped in a step 544, then chronographic time counting is reset. The difference between the chronographic hand position and the 0-position or a reference position is calculated in a step 546. The respective CG hands are fast driven to the indicated 0-position in a step 548 as will be shown later in the flowchart of FIG. 22. "CG start" is written in memory 204 in a step 550 and the chronographic circuit 211 is reset in a step 552.

Figure 20B:
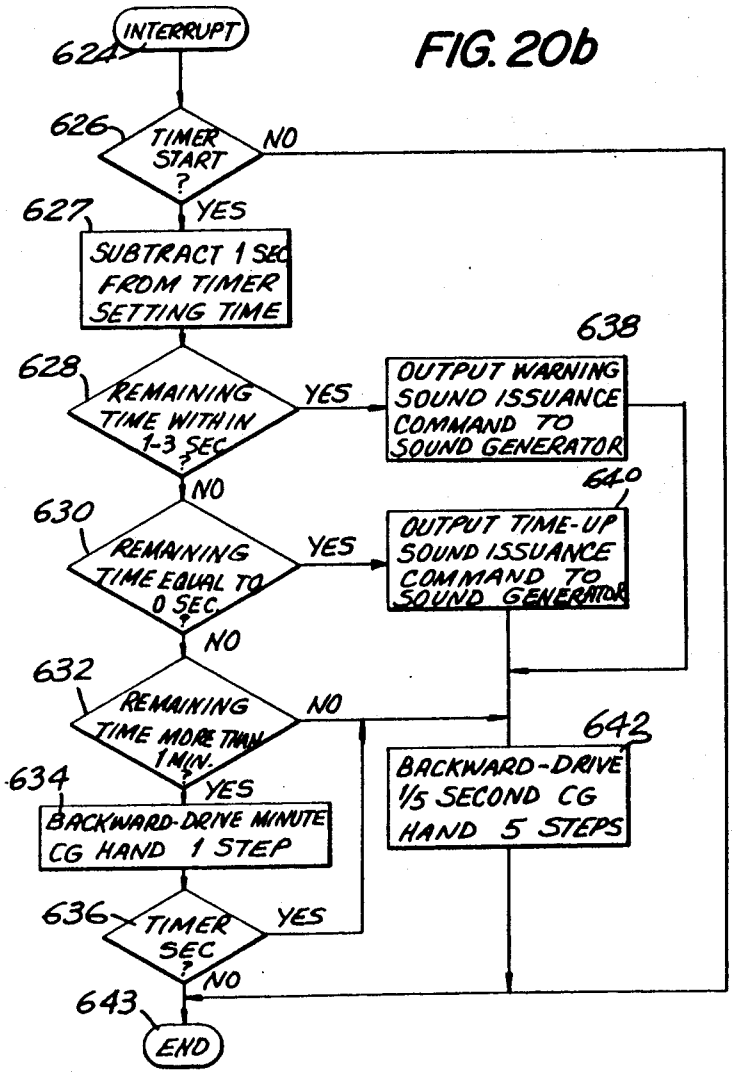
FIGS. 20*a*, 20*b* are flowcharts for timer operation of the electronic timepiece.
Figure 20A:
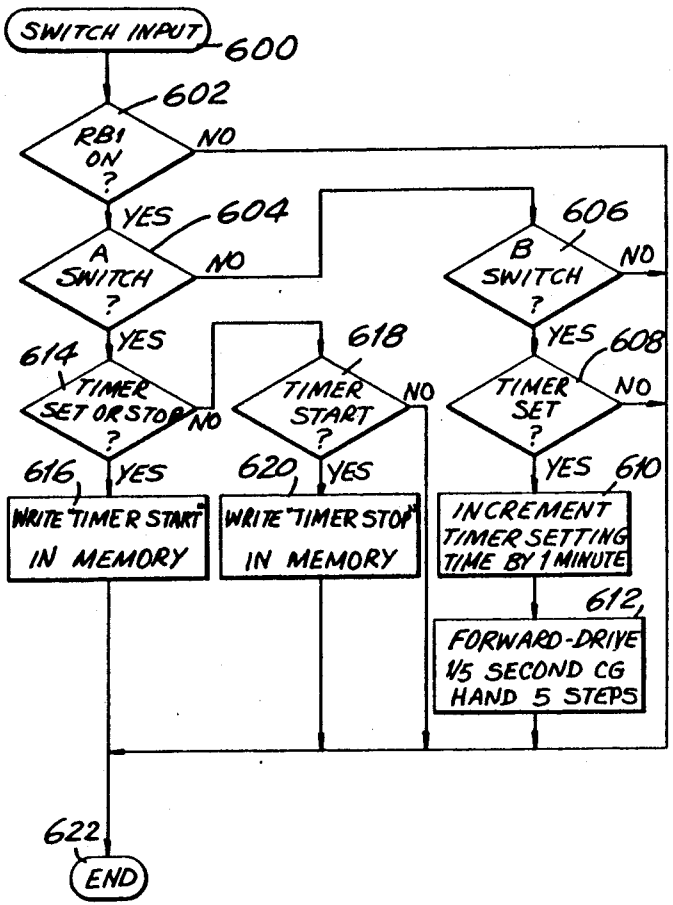

Reference is now made to FIGS. 20*a*, 20*b* in which a flowchart for operating electronic analog timepiece 100 in an elapsed timer mode is provided. The timer must first be set to the desired time period. The timer setting is indicated by the 1/5 second CG hand 21 second winding stem 23 is set to a first step to activate switch 59*a* in a step 600 so that switch 59*a* is on at the RB1 terminal in a step 602. When switch 59*a* has been turned on at terminal RB1, electronic analog timepiece 100 is in the timer mode. When switch B is activated in a step 606 during a timer setting in step 608, the timer setting time is incremented by one minute in a step 610. The 1/5 second CG hand 21 is driven forward by one minute or five step increments in a step 612. The graduations 41*a* of dial 41 indicated by the 1/5 seconds CG hand 21 represents the timer setting time period. The timer setting time period may be set to a value as great as sixty minutes.

Activation of switch A 24 starts and stops in a timing processes in accordance with a step 604. The timer function is started in a step 618, and interrupt signal is provided in a step 624. To start the timer in a step 626, the minute CG hand 31 is driven counterclockwise in units of seconds to subtract one second from the timer setting time in a step 627. It is determined whether the time remaining on the timer is more than one minute in a step 632. If the remainder timer time is greater than one minute and the minute CG hand 31 is driven backwards step in a step 634. When a timer time period is set at more than one minute or the remaining time period is less than one minute as determined in a step 636, the minute CG hand 31 is stopped and the 1/5 CG hand 21 is driven backwards to count down the elapsed time in the unit seconds in a step 642.

It is determined whether the time remaining in the elapsed time period is within a range of one to three seconds in a step 628. If the remaining time falls in this range an output warning sound issuance command is output to sound generator 210 in a step 638 and the 1/5 second CG is continued to be driven backwards in a step 642. When the remaining time is determined to equal zero seconds in a step 630, a time sound issuance command is output to sound generator 210 in accordance with step 640. The output stops in accordance with a step 643. Once an elapsed time period has been completed, the "timer stop" is written in data memory 204 in a step 620. Additionally, it is determined whether the timer is set or stop in a step 614. If the timer is set or stop the "timer start" is stored in data memory 240 in a step 616. The timer operations ends in a step 622.

Figure 21A:
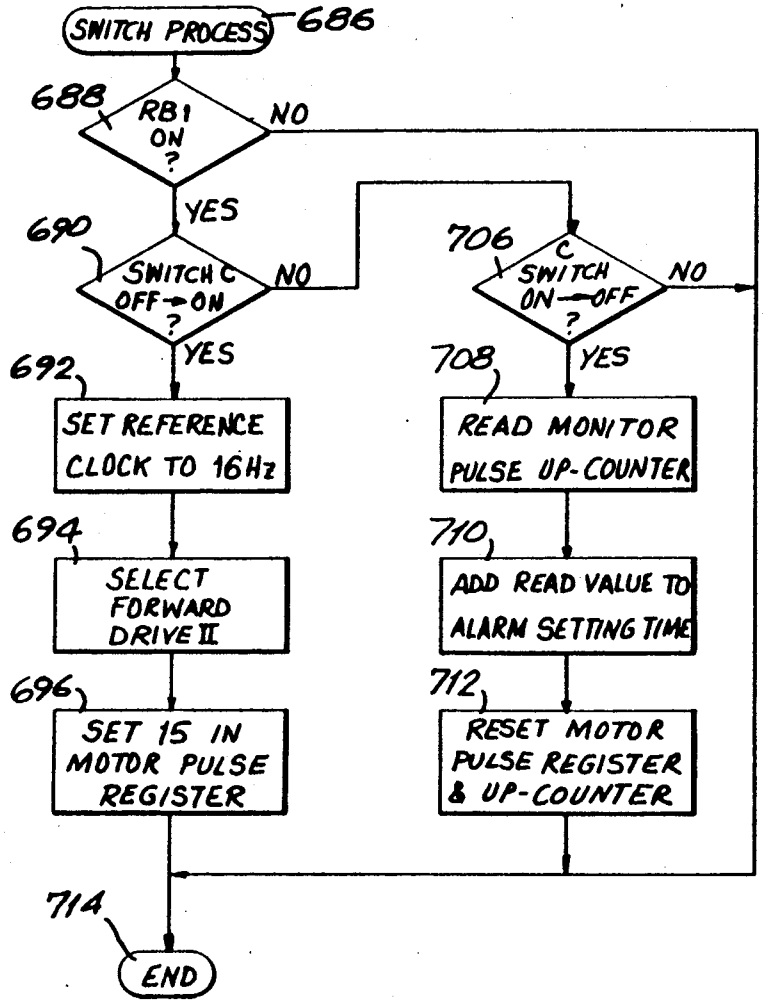
FIGS. 21*a*, 21*b* are flowcharts for setting the alarm of the electronic timepiece;.
Figure 21B:
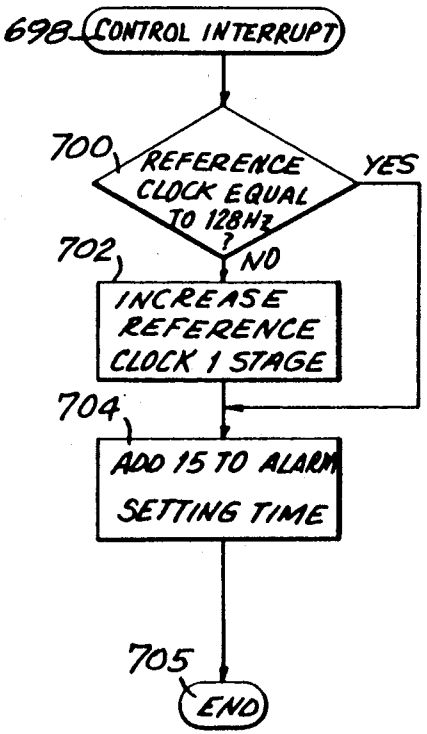

Reference is now made to FIGS. 21*a*, 21*b* in which the operation of electronic analog timepiece 100 in the alarm setting mode is provided. Second winding stem 23 is moved to a first step activating switch 59*a* in a step 687 causing switch 59*a* to be on at terminal RB1 in a step 688. If a switch C 26 is continuously pushed in a step 690 then the programmable frequency divider 2205 in accordance with a step 692 provides an input to motor coil control circuit D 229 in response to a command from CPU 201. Motor drive pulse electric circuit D 237 receives a forward drive II input in a step 694. A value of 15 is input into the register ("motor pulse register") of trigger forming circuit 233 in a step 696. When a value of 15 is input into the motor pulse register, the motor pulse continues to be output until data different from 15 is input to the motor pulse register. Therefore, an alarm hour and minutes hands driven by motor drive D 216 are continuously rotated at a rate of 16 Hz until resetting of the reference clock.

When the fifteen motor pulses are output, trigger forming circuit D 233 produces a control interrupt in step 698. If the reference clock has not yet obtained a value of 128 Hz in accordance with a step 700, then the reference clock and the programmable frequency divider 225 is increased in response to a CPU command to increase its frequency by one stage in a step 702. Fifteen pulses are then added to the alarm setting time in a step 704. Enabling the unique hand drive correction method in which the correction speed is increased in a stepped manner by fifteen motor pulses. This method is known as accelerated correction.

Figures 24A, 24B, 25:
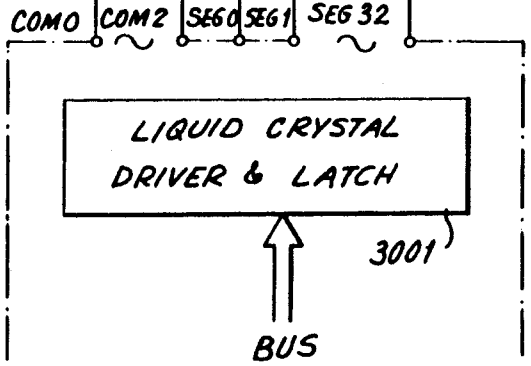
FIGS. 24*a*, 24*b* are tables representing patterns for correction at an accelerated speed.
FIG. 25 is a block diagram of an electronic timepiece constructed in accordance with another embodiment of the invention.
Figure 26:
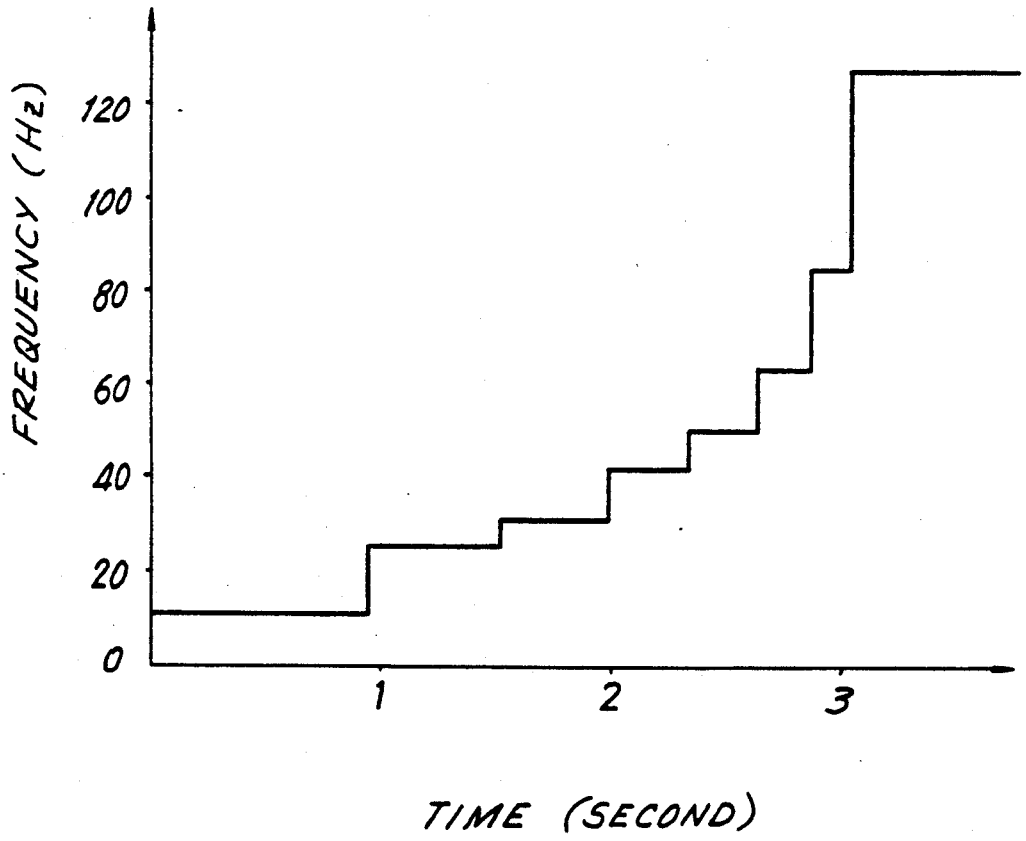
FIG. 26 is a graphical illustration of the relationship between the correction time and hand drive speed during a forward driving accelerated correction.

Reference is now made to FIG. 26 in which the relationship between the correction time and frequency is provided to illustrate the relationship between prior correction times at a given frequency and correction of time obtainable using electronic analog time 10 at higher frequencies. Experimentation has proved that acceleration of the hand drive speed can originally appear to the user as a continuous hand drive speed by setting the hand drive speed to one or two intermediate stages before doubling the speed. As seen in FIGS. 24*a*, 24*b* by constantly measuring every fifteen motor pulses output to the step motor the reference clock frequency may still be increased. Because alarm minute hand 38 has already been driven through 15 steps and continues to be driven until the occurrence of the control interrupt, each fifteen pulses from the moment in time when the correction is started or when the previous control has occurred, the alarm setting time is incremented each fifteen steps.

Reference is now made to FIGS. 22*a*–22*c* in which flowcharts for motor driving the indicator hands of electronic analog time piece 100. FIG. 22*a* illustrates a hand drive method when the number of drive pulses applied to the motor is less than 14. The motor hand drive are driven in a normal mode in accordance with the step 650. It is determined whether backward or forward drive I pulses are being produced in a step 652. If these pulses are being produced the reference clock is set to 64 Hz in a step 656. The hand drive mode is then set in step 658 and a number of pulses in register 2261 is set in a step 660. If no backward or forward drive pulses are detected in step 652, the reference clock is set to 128 Hz to perform fast driving in accordance with a method 664.

To perform fast driving, control interrupt is provided in a step 676 to interrupt operation to allow interrupt of the fast drive motor in a step 678. During operation of the fast drive motor it is determined whether the number of output pulses is larger than 14 in a step 680. If the number of pulses is less than 14, then the number of pulses is input to motor pulse register 2261 in a step 662. If the number output pulses is greater than 14, 15 pulses are subtracted from the number of output pulses in a step 684. The reference clock Cdrv is set to 128 Hz in a step 666 accelerating motor driving. A forward drive II is input in a step 668 and fifteen pulses are input into register 2261 in a step 667. Fifteen pulses are then subtracted from the number of output pulses in a step 672.

The accelerated correction of the alarm time setting may be terminated by first turning off the switch C 26 in accordance with a step 706. Up counter 2262 of trigger forming circuit D 233 ("motor pulse up counter") is read in response to a command from the CPU in a step 708. This terminates the output of motor pulses. At this time, because the alarm minute hand 38 has been advanced through those steps corresponding to the values read from the time when the previous control interrupt has occurred, that value is added to the alarm setting time to correct the alarm setting time in a step 710. The motor pulse register and the motor pulse up counter are then reset in a step 712.

In the above embodiment, the hand drive speed is increased in a step fashion every 15 motor pulses providing an appearance of relatively fast acceleration of the hand. If the hand drive speed was to be increased in a step manner every 30 motor pulses, a relatively slow acceleration of hands would appear to occur. The acceleration of the hand drive speed can also be made to appear to occur in a continuous fashion. A similar effect is obtainable even if the pattern of change in the hand drive speed is modified in a manner different from that illustrated above.

Figure 23B:
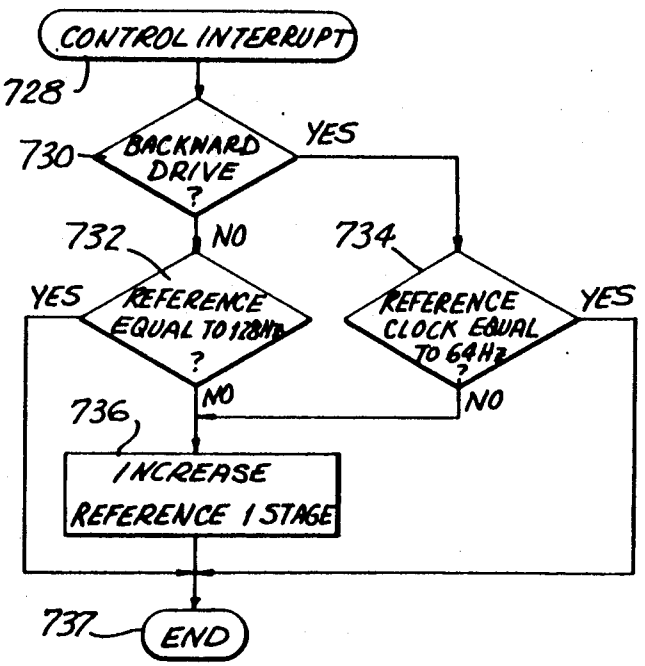
FIGS. 23*a*, 23*b* are flowcharts showing the reference position corrector a chronographical 1/5 second hand.
Figure 23A:
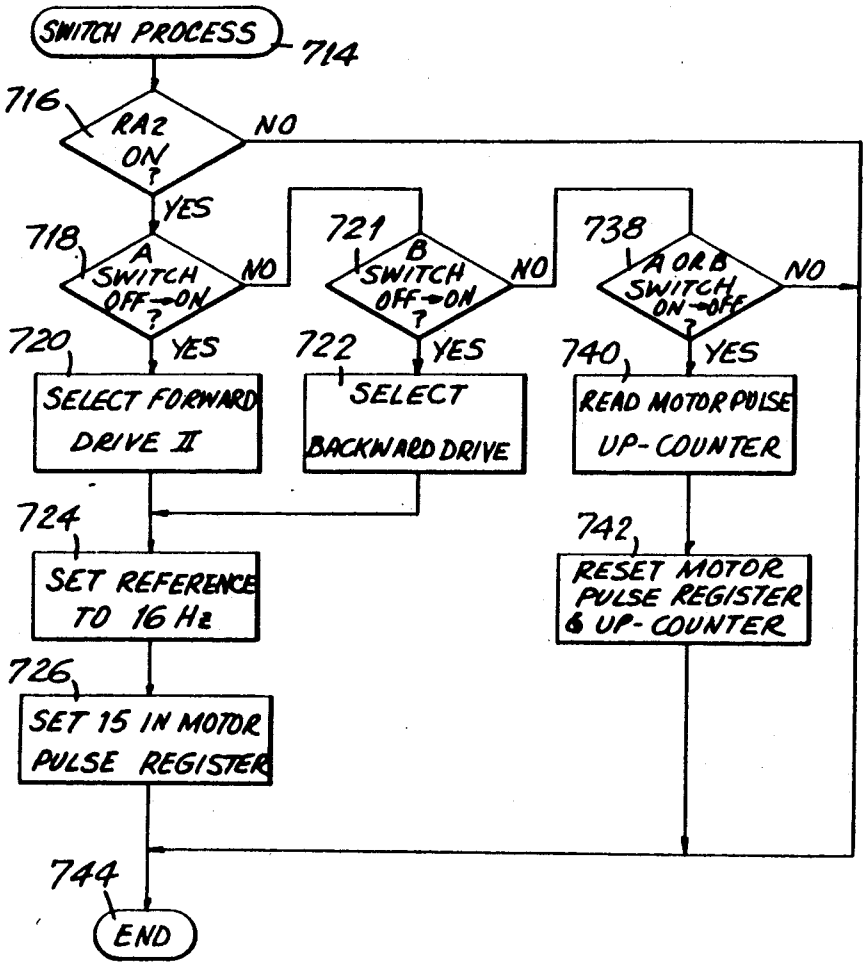

Reference is now made to FIGS. 23*a*, 23*b* in which the operation for correcting the reference or 0-position of the CG 1/5 second hand 21 is depicted. First winding stem 22 is set to its second step switching switch 46*a* on a terminal RA2 in step 716. If switch A 24 is turned on in a step 718 and forward drive II is selected in response to a command from the CPU in a step 720. If switch B 25 is pushed on in a step 721 a backward drive mode is selected in response to a command from CPU 201 in a step 722. A 16 Hz signal is input in programmable frequency divider 2205 of motor clock control circuit B 227 in a step 724.

The data value 15 is input into the motor pulse register of trigger forming circuit B 231 in a step 726. As mentioned above, when 15 is input in a motor pulse register, the motor pulse is continued to be output until data other than 15 is input to the motor pulse register. Therefore, the CG 1/5 second hand 21, driven by a motor drive D 214, is continuously rotated at a rate of 16 Hz until resetting of the reference clock Cdrv.

When the 15 motor pulses are output, trigger forming circuit B 231 produces a control interrupt in a step 728. If the motor is in a forward drive in accordance with a step 730, it is determined whether the reference clock has reached 128 Hz in a step 732. If the reference clock has not reached the 128 Hz level, then the reference clock of programmable frequency divider 2205 is increased upwards one stage in response to a command from the CPU in a step 736. If it is determined that the motor is undergoing backward drive in a step 730, it is then determined whether the reference clock has reached a value of 64 Hz in a step 734. If the 64 Hz value has not been reached then the reference clock output by programmable frequency divider 2205 is again increased in a step 736. This increases the correction speed in a step manner by fifteen motor pulses for allowing different patterns of the accelerated correction for both forward and backward drive as shown in FIGS. 24*a* (forward drive) and 24*b* (backward drive). This accelerated correction is terminated by turning either switch A 24 or B 25 in a step 738. The motor pulse up counter of trigger forming circuit B 233 is read in response to a command from CPU 201 in a step 740 stopping the output of motor pulses. The motor pulse register and the motor pulse up counter are then reset in step 742.

In the above embodiment, the hand drive speed is only changed to increase the speed. In correcting the alarm time for example, if the correction speed is slowed at least once during continuous correction when the hands have reached a time substantially one hour less than the previously set alarm time, it becomes possible to easily reset the alarm time at a time slightly earlier than the previous alarm time even with correction actuatable in the forward direction.

Figure 27:
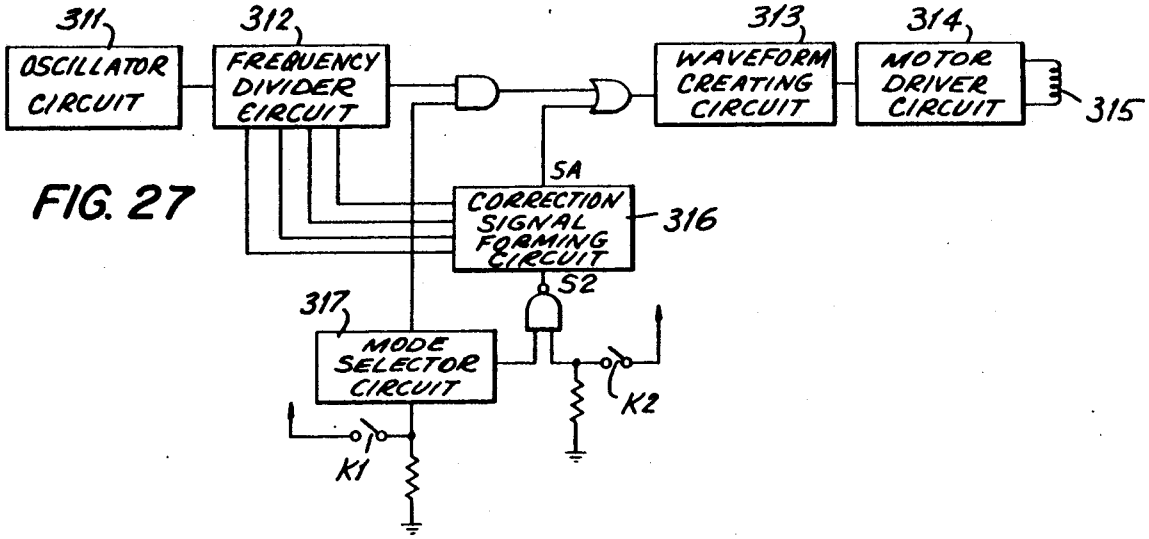
FIG. 27 is a block diagram of an electronic analog timepiece constructed in accordance with the invention.
Figure 28:
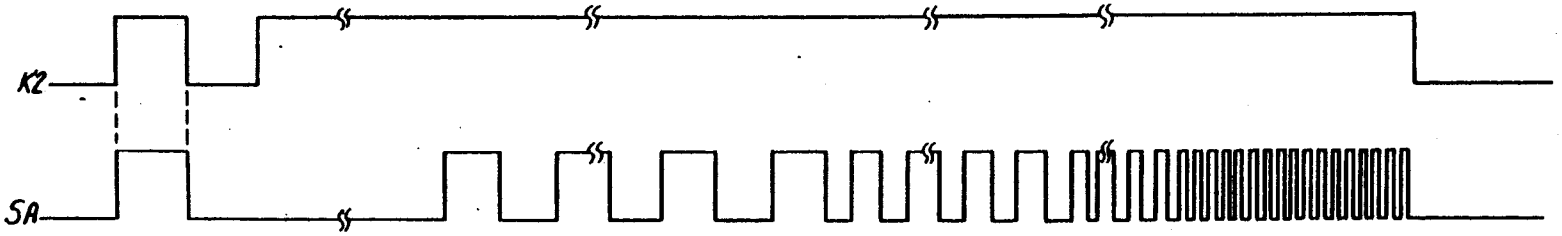
FIG. 28 is a timing chart with a switch input to the correction signal forming circuit constructed in accordance with the analog electronic timepiece of FIG. 27.
Figure 29:
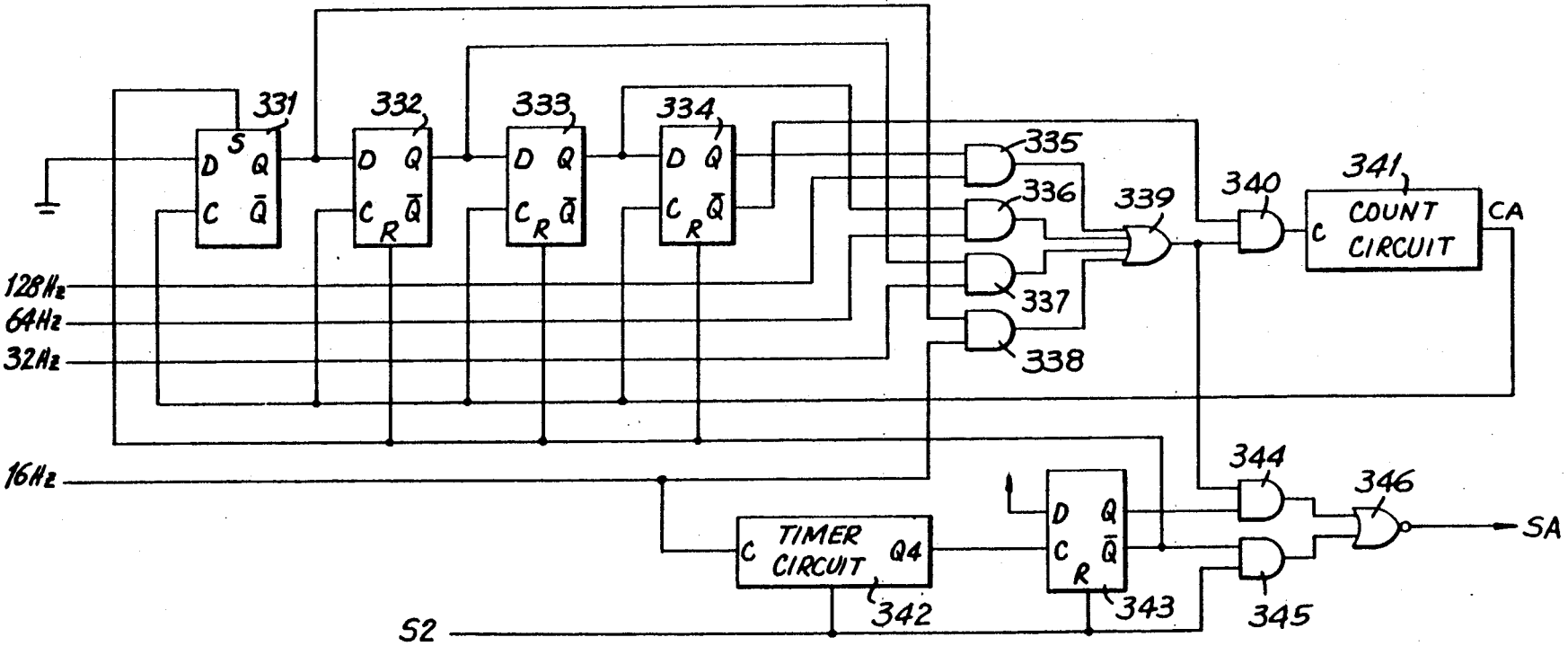
FIG. 29 is a circuit diagram of the correction signal forming circuit.

Reference is now made FIGS. 27–29 in which embodiments for a hand drive speed changing drive circuit are provided. A block diagram applying the present invention to time correction for an electronic analog timepiece is illustrated in FIG. 27. An oscillator circuit 311 produces a signal having an oscillation frequency of 32768 Hz. A frequency divider circuit 312 divides the input oscillation signal 16 times to output a series of signals ranging from the original frequency down to 1 Hz. A switch K1 provides an input to a mode selector circuit 317. Mode selector circuit 317 selects between a time clock mode and a time correction mode dependent on the switch input through switch K1. Mode selector circuit 317 provides a signal to an AND gate 320. AND gate 320 also receives a 1 Hz input signal from frequency divider circuit 312 and provides a first input to an OR gate 321.

Mode selector 317 produces 1 Hz signal which is fed from the dividing circuit to the waveform form signal which gates the signal. Mode selector 317 also controls a signal of 16 Hz as well as a signal of 1 Hz. AND gate 322 receives a second input through a switch K2 and produces an output S2 for correction signal forming circuit 316. Correction signal forming circuit 316 also receives 32 Hz, 64 Hz, and 128 Hz inputs produced by frequency divider circuit 312. Correction signal forming circuit 316 produces a single shot correction signal and a fast drive correction signal output as SA as an input to OR gate 321 which provides a gated input to waveform creating circuit 313.

In response to the gated inputs from frequency divider circuit 312 and correction signal forming circuit 316, waveform creating circuit 313 generates a hand drive signal on the order of substantially 4 msec. A motor driver circuit 314 receives this input and drives a step motor 315.

Reference is now made to FIG. 28 in which a timing chart representing switch input through K2 and output signals from SA of correction signal forming circuit 316 are provided. As can be seen, actuating push switch K2 outputs a single shot correction signal from SA during a time correction mode. If switch K2 is continuously held in the on state for a period of time greater than or equal to one second, a fast drive correction signal of 16 Hz is output from SA. Whenever 16 shots or drive pulses are exceeded before reaching the intended amount to be corrected, the fast drive correction signals increase to increase the fast drive correction speed in a step manner from 16 Hz to 32 Hz, 64 Hz and finally to 128 Hz. When reaching the maximum rate of 128 Hz, the correction speed is held at that rate. The fast drive correction is stopped by turning off push switch K2.

Reference is now more particularly made to FIG. 29 in which a circuit diagram for producing the fast drive correction signal is provided. A timer circuit 342 and a flip flop 343 receives a switch input through S2. The switch input is normally held at a high level keeping both timer circuit 342 and flip flop 343 in a reset state. An AND gate 345 also receives the switch input S2.

Timer circuit 342 receives a 16 Hz signal through an input C causing timer circuit 342 to count. If switch input S2 is held high for 1 second, timer circuit 342 is caused to overflow and outputs a high level signal from output Q4.

Four flip flops 331–334 are arranged to form a cascading up count arrangement. A reference voltage supplied at the D input of the flip flop 331 is output D terminal of flip flop 332 which in turn produces a Q output to the D terminal of flip flop 333 which in turn produces a Q output to the D terminal of flip flop 334. Four AND gates 235, 236, 238 receive input signals 128 Hz, 64 Hz, 32 Hz and 16 Hz respectively and output these signals under the control of flip flops 231–234. AND gate 335 receives the Q output of flip flop 334. AND 336 receives the Q output of flip flop 333. AND gate 337 receives the Q output of flip flop 332 and AND gate 338 receives the Q input of flip flop 331. OR gate 339 receives the gated outputs of AND gates 335, 336, 337, 338 and produces a gated output to AND gate 344 and to OR gate 340. OR gate 340 receives the $\overline{Q}$ output of flip flop 334.

A count circuit 341 receives the output of AND gate 340 at an input terminal C and produces a signal CA input at terminal C of flip flops 331, 332, 333 and 334. And S output of flip flop 331 resets flip flops 332, 333 and 334 and provides an input to AND gate 345.

Flip flop 343 receives the output from timer circuit 342 at a C input changing flip flop 343 from a low level to a high level changing the outputs of Q from a low level to a high level and the $\overline{Q}$ output from a high level to a low level. AND gate 345 receives the $\overline{Q}$ output from AND gate 345 closing AND gate 345.

AND gate 344 becomes open. An output of OR gate 339 is input so that a fast drive reference signal passes through AND gate 344 and NOR gate 346 as an output from SA. When S2 is high, the signal input through switch S2 passes through both AND gate 345 and NOR gate 346 reaching SA. As a result, a single shot correction signal is issued from SA.

Fast drive correction reference signal is formed by selecting any one of the input frequency signal 16 Hz, 32 Hz, 64, Hz and 128 Hz. Flip flops 331, 332, 333 and 334 each select a respective signal in increasing order so that flip flop 331 controls selection of the 16 Hz signal and flip flop 334 controls the 128 Hz signal. Any one of the fast drive reference signals can be selected through AND gates 335–338 and NOR gate 339.

When the fast drive correction signal is not being selected by flip flop 343, the $\overline{Q}$ output of flip flop 343 holds a level so that flip flops 332–334 are kept in a reset state and flip flop 331 is kept in the set state. If a switch input through S2 continues to be applied longer than a predetermined period of time, the fast drive correction is selected and the $\overline{Q}$ output of flip flop 343 changes from a high level to a low level, where upon flip flop 331 and flip flops 332–334 are turned to the reset state and set state respectively.

The fast drive reference signal output from OR circuit 33 is applied to counter circuit 341 after having been gated by AND gate 340 except for that case in which 128 Hz signal is selected. Counter circuit 341 produces a carry output whenever 16 pulses of the fast drive reference signals are applied thereto so that the cascaded flip flops 331–334 are each shifted by one bit. The count number for delivering the carry output from counter circuit 341 can be set at 15 as in the above embodiments and any desired number may also be selected rather than 15. Immediately upon the fast drive correction, flip flop 331 is in the set state and the 16 Hz reference signal is selected. When 16 shots or drive pulses are exceeded, the correction speed is shifted from 16 Hz, 32 Hz, 64 Hz and 128 Hz in an increasing step fashion. When reaching the maximum rate of 128 Hz, AND gate 340 prevents the fast drive correction signal from being output to counter circuit 341. Therefore, after the fast drive reference signal has reached 128 Hz, the 128 Hz fast drive correction signal is continuously output.

When switch S2 is turned off, timer circuit 342 and flip flop 343 are reset so that the Q output is turned low and the $\overline{Q}$ output is turned high. As a result fast drive correction is stopped and one shot correction may be performed.

Reference is now made to FIG. 25 in which another embodiment of the present invention is depicted. A liquid crystal driver end latch 3001 is provided on CMOS-IC 20. A liquid crystal display 3002 driven by liquid crystal driver latch 3001 is coupled to CMOS-IC 20. In response to software commands, liquid crystal display 3002 indicates time of day, a second time different from the time of day, calendar date, alarm and timer setting time, and chronographic time in digital representation.

By providing an electronic analog timepiece in which the drive speed of the hand is increased or decreased in a step manner by a correction signal forming circuit during the continuous correction of time of day, alarm setting time, setting time period of the timer, reference position of the hand and the like it is possible to realize an electronically corrected electronic timepiece having analog display and the ability of quick and easy electronic correction. Use of the correction steps in accordance with the invention decreases the chances of making improper correction resulting in redoing correction steps contributing in saving of current consumption, lessening wear of the operating members and proving the long term reliability.

Additionally, accelerated correction is performed in a manner giving a user a natural operating feeling lessening the frustration of the timepiece user during operation. Because the setting of the correction pattern may be adapted to the end use the feeling of ease of operation is even more greatly enhanced.

By setting the correction speed to be slower as the hands approach the reference positions at which they are to be set and faster when they are passing in an area far from the reference positions, it becomes easier to set the reference positions again reducing the frustration of potential users of the timepiece. When setting the alarm time, the correction speed may be reduced when the hands pass such times which are used at a relatively high frequency, thereby facilitating alarm time setting. In unidirectional correction, even backward correction of a small amount can be easily performed by slowing down the hand drive speed just before full turn of the hands has occurred during correction.

Although correction speed may be manually selectively changed, no switch for changing the correction speed is required simplifying both arrangement and operation as compared with manual switching.

It will thus be seen that the objects set forth above, among those made apparent by the preceding description, are efficiently attained and since certain changes may be made in carrying out the above method and in the construction set forth without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, may be said to fall therebetween.

What is claimed is:

1. A method for setting an indicator on an electronically correcting electronic timepiece having an indicator for indicating the time, a step motor for driving the indicator, correction signal forming circuit for producing a drive pulse for driving the step motor to correct said indicator, control means for producing a control interrupt and for controlling said correction signal forming circuit to change the speed of the indicator in steps during correction of the indicator, including the steps:

switching the timepiece to an indicator setting mode;

inputting a reference clock value to the control means;

controlling the correction signal forming circuit in response to the reference clock value;

inputting a forward drive command to the correction signal forming circuit;

inputting a data value to the control means;

driving the indicator at a continuous speed for a period corresponding to the input data value;

producing a control interrupt; and increasing the reference clock value if the reference clock value is less than a predetermined value.

2. The method of claim 1, wherein said step motor drives the indicator in response to a drive pulse and further including the step of increasing the drive pulse frequency for driving the indicator in steps during correction of the indicator by selecting the drive pulse from at least one of a first drive pulse having a first frequency, a second drive pulse having a second frequency greater than the value of the first frequency and a third pulse having a third frequency greater than the first frequency and less than the second frequency.

3. The method of claim 2, wherein the second frequency is double the first frequency.

4. The method of claim 2, wherein said second frequency is more than twice said first frequency.

5. The method of claim 1, wherein said indicator indicates a set alarm time.

* * * * *